US007197888B2

(12) United States Patent
LeClear et al.

(10) Patent No.: US 7,197,888 B2
(45) Date of Patent: Apr. 3, 2007

(54) DRAWER APPLIANCE

(75) Inventors: Douglas D. LeClear, Coloma, MI (US); Paul B. Allard, Stevensville, MI (US); Karen J. Querfurth, Coloma, MI (US); Andrew M. Tenbarge, St. Joseph, MI (US); Michele W. Wilcox, Stevensville, MI (US); Chad E. Lange, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 158 days.

(21) Appl. No.: 11/102,322

(22) Filed: Apr. 8, 2005

(65) Prior Publication Data

US 2005/0236946 A1 Oct. 27, 2005

Related U.S. Application Data

(60) Provisional application No. 60/561,860, filed on Apr. 13, 2004.

(51) Int. Cl.
*F25D 17/04* (2006.01)

(52) U.S. Cl. ..... 62/186; 62/382

(58) Field of Classification Search ..... 62/186, 62/382, 407, 442, 446, 448, 203, 302, 441; 312/236, 330.1, 402, 348.3, 291, 229
See application file for complete search history.

(56) References Cited

U.S. PATENT DOCUMENTS 2,163,182 A * 6/1939 Warren et al. ..... 62/266
2,312,325 A * 3/1943 Earle ..... 312/273
2,498,402 A * 2/1950 Earle ..... 312/351
2,515,766 A 7/1950 Earle ..... 62/89
2,539,613 A 1/1951 Earle ..... 62/89
2,592,233 A 4/1952 Atchison ..... 62/163
2,618,936 A 11/1952 Kennedy ..... 62/89
2,734,351 A * 2/1956 Stewart ..... 62/450
2,798,367 A * 7/1957 Earle ..... 62/382
2,836,968 A * 6/1958 Ferris ..... 62/258
2,961,851 A 11/1960 Ehrenfreund ..... 62/448
3,048,462 A * 8/1962 Fisher ..... 312/402
3,077,749 A 2/1963 Jung et al. ..... 62/419

(Continued)

FOREIGN PATENT DOCUMENTS

DE 26 48 237 8/1977

(Continued)

*Primary Examiner*—Mohammad M. Ali
(74) *Attorney, Agent, or Firm*—Robert O. Rice; Stephen Krefman; John F. Colligan

(57) ABSTRACT

A modular cabinet for a family of drawer appliances including an insulated liner defining a drawer space, a machine compartment, a wiring harness leading from the machine compartment to the drawer space, a passage leading from the machine compartment to the drawer space and an air passage leading from the machine compartment to the front of the cabinet and a drain leading from the liner space to the machine compartment. The family of drawer appliances can include refrigerator, freezer, ice maker, wine and warming drawers. A drawer can have two compartments and can be maintained at two temperatures. The drawers include an insulated front and a bin and can be slidably carried in the drawer space. The modular cabinet and control can be used for each member of the family of drawer appliances.

20 Claims, 20 Drawing Sheets

U.S. PATENT DOCUMENTS

| | | | | | |
|---|---|---|---|---|---|
| 3,199,579 | A | | 8/1965 | Foster et al. | 165/48 |
| 4,123,130 | A | | 10/1978 | Locke | 312/285 |
| 4,457,140 | A | | 7/1984 | Rastelli | 62/261 |
| 4,662,186 | A | | 5/1987 | Park | 62/265 |
| 5,120,118 | A | * | 6/1992 | Rankin | 312/402 |
| 5,277,039 | A | * | 1/1994 | Haasis | 62/448 |
| 5,546,759 | A | | 8/1996 | Lee | 62/441 |
| 5,657,639 | A | | 8/1997 | Lidbeck | 62/186 |
| 5,661,978 | A | | 9/1997 | Holmes et al. | 62/3.6 |
| 6,484,529 | B2 | | 11/2002 | Dasher et al. | 62/344 |
| 6,837,068 | B2 | * | 1/2005 | Wood | 62/442 |

FOREIGN PATENT DOCUMENTS

| | | | | |
|---|---|---|---|---|
| FR | 2613916 | A3 | | 10/1988 |
| FR | 2797684 | | | 1/2002 |
| JP | 407248171 | A | * | 9/1995 |
| JP | 409313269 | A | * | 12/1997 |
| WO | 99/56071 | | | 11/1999 |

* cited by examiner

DRAWER APPLIANCE

CROSS REFERENCE TO RELATED APPLICATIONS

This application claims the benefit of Provisional Patent Application No. 60/561,860 filed on Apr. 13, 2004.

BACKGROUND OF THE INVENTION

This invention relates to drawer appliances that can be arranged to refrigerate or heat the contents of the drawer. The drawer appliances can be built in to a cabinet or can be arranged to be free standing units.

SUMMARY OF THE INVENTION

In one aspect the invention relates to a refrigerated drawer appliance comprising a cabinet having an insulated drawer space and a machine compartment; an insulated mullion dividing the drawer space into two compartments; a refrigeration system including an evaporator in the drawer space and a compressor in the machine compartment arranged for cooling each of the compartments to an independently selected temperature; and a drawer comprising two bins arranged to be positioned in the two compartments when the drawer is in the closed position. The bins are arranged to enter the drawer space on opposite sides of the mullion. The drawer comprises an insulated front with the bins attached to the inside of the front.

The refrigeration system includes at least one evaporator in one of the compartments and can include an evaporator in each of the compartments.

The refrigerated drawer appliance includes a control for independently controlling the temperature in the two compartments and a user interface on the drawer for selecting the temperatures for the two compartments. The drawer can include a display for displaying the temperatures in the compartments.

The drawer can include a hinged lid for at least one of the bins. The drawer includes a front wall and can include at least one window in the drawer front wall for viewing the contents of at least one of the bins when the drawer in positioned in the drawer space. The drawer can include a light to illuminate the interior of at least one of the bins when the drawer is positioned in the drawer space.

The drawer can include a wine rack in at least one of the bins for holding a plurality of wine bottles that can hold a plurality of bottles spaced apart for viewing when the drawer is positioned in the drawer space.

The drawer can include a slidable tray covering the open top of the drawer in a closed position and exposing the open top of the drawer in an open position. The slidable tray can include a plurality of recesses arranged for holding utensils and serving accessories.

In another aspect the invention relates to a refrigerated drawer appliance comprising an insulated cabinet having a drawer space and a machine compartment; an insulated mullion in the liner dividing the drawer space into two compartments; at least one evaporator positioned in one of the compartments connected to a compressor and a condenser in a refrigeration circuit; a first fan positioned adjacent the evaporator in the one of the compartments; a second fan positioned in the liner arranged to circulate refrigerated air into the other of the two compartments; a temperature sensor for each of the two compartments connected to a control arranged to control operation of the compressor and the first and second fans; and a drawer including an insulated front wall and two bins arranged to be positioned in the two compartments when the drawer is in the closed position. The second fan is positioned in the mullion to circulate refrigerated air into the other of the two compartments.

The drawer can include a front wall including windows for viewing the contents of the bins when the drawer in positioned in the drawer space and can include includes a light to illuminate the interiors of each of the bins when the drawer is positioned in the drawer space.

The drawer can include a wine rack in at least one of the bins for holding a plurality of wine bottles spaced apart for viewing when the drawer is positioned in the drawer space.

DESCRIPTION OF THE INVENTION

Figure 1:
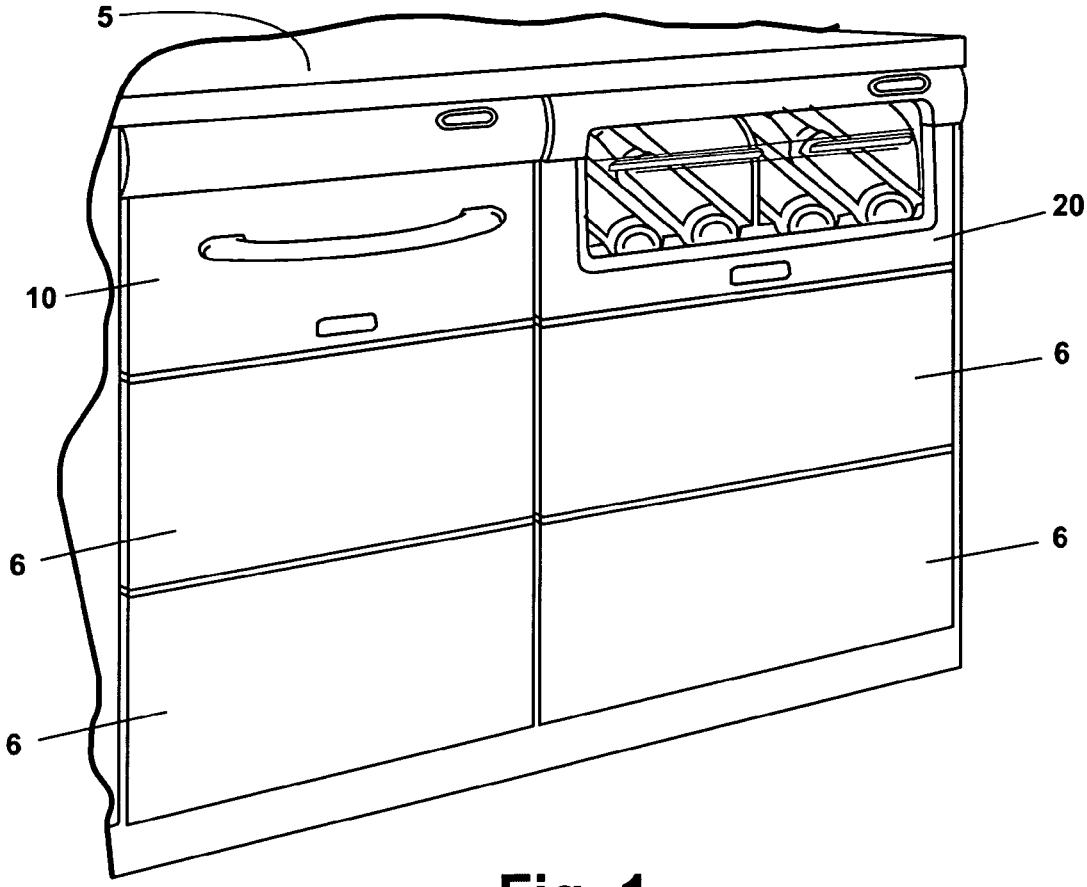
FIG. 1 is a perspective view of two drawer appliances according to the invention installed in a counter unit.

Built-in refrigerator and warming units designed for counter installation or free-standing application are desirable solutions for handling overflow cool or warmed storage or for keeping cooled or warmed food items at convenient locations in the home. Such units can include refrigerated drawers, freezer drawers and warming drawers. According to the invention a modular drawer appliance can be arranged to provide these functions with a minimum investment and maximum flexibility. Turning FIG. 1, drawer appliance units 10 and 20 are shown installed in a counter unit 5 such as are typically found in kitchens and recreation rooms in homes and in offices. A plurality of other conventional drawers 6 can be provided in the counter unit 5, or, as will be readily understood by those skilled in the art, drawers 6 can be replaced by storage areas closed by one or more doors. Likewise, one or more conventional drawers 6 can be replaced by one or more additional drawer appliances. In the embodiment of FIG. 1 two temperature refrigerated drawer appliance 20 can be a wine drawer that can be arranged to maintain bottles of wine at a selected temperature as will be described in greater detail below. Drawer appliance 10 can be a refrigerator drawer, a freezer drawer, an ice drawer or a warming drawer as will be described in greater detail below.

Figure 3:
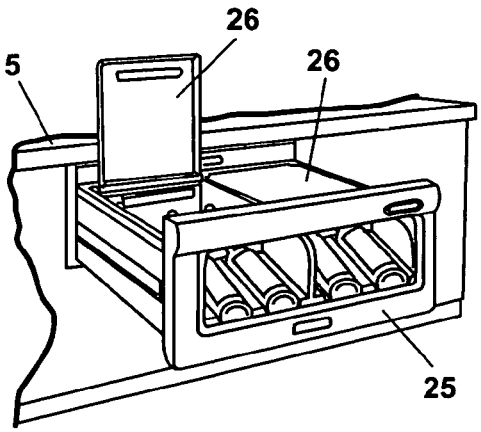
FIG. 3 is a partial perspective view of one of the drawers shown in FIG. 1 opened showing another embodiment of a cover.
Figure 2:
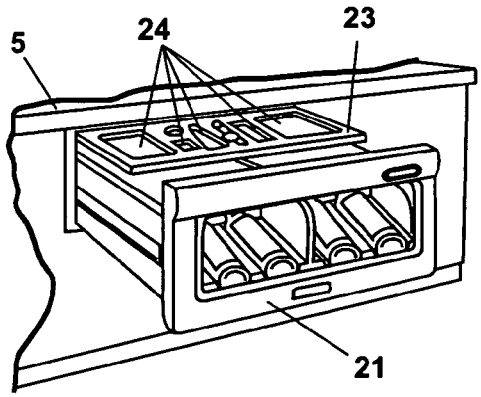
FIG. 2 is a partial perspective view of one of the drawers shown in FIG. 1 opened showing one embodiment of a cover.

Turning to FIG. 2 and FIG. 3, two embodiments of a two temperature refrigerated drawer that can be a wine drawer can be seen. In the embodiment of FIG. 2 wine drawer 21 is shown withdrawn from its cabinet in counter unit 5. Wine drawer 21 can include a utility tray 23 that can include a plurality of recesses 24 that can be arranged to hold various utensils and accessories used in conjunction with serving wine such as a corkscrew, napkins, wine glass markers, coasters, foil cutter and the like. Those skilled in the art will readily understand that utility tray 23 can be slidably carried by the drawer 21, or the cabinet as shown in FIG. 2. Utility tray 23 can be arranged to substantially cover the open top of drawer 21 when utility tray 23 is positioned against the rear surface of the drawer front. In the embodiment of FIG. 3 wine drawer 25 is shown withdrawn from its cabinet mounted in counter unit 5. Wine drawer 25 can include a pair of hinged lids 26 each arranged to cover a portion of drawer 25. As will be described in greater detail below, a refrigerated drawer appliance can be arranged with two compartments that can be maintained at different temperatures. Two hinged lids 26 can be advantageously used with a wine drawer arranged to maintain the two compartments at different temperatures.

Figure 4:
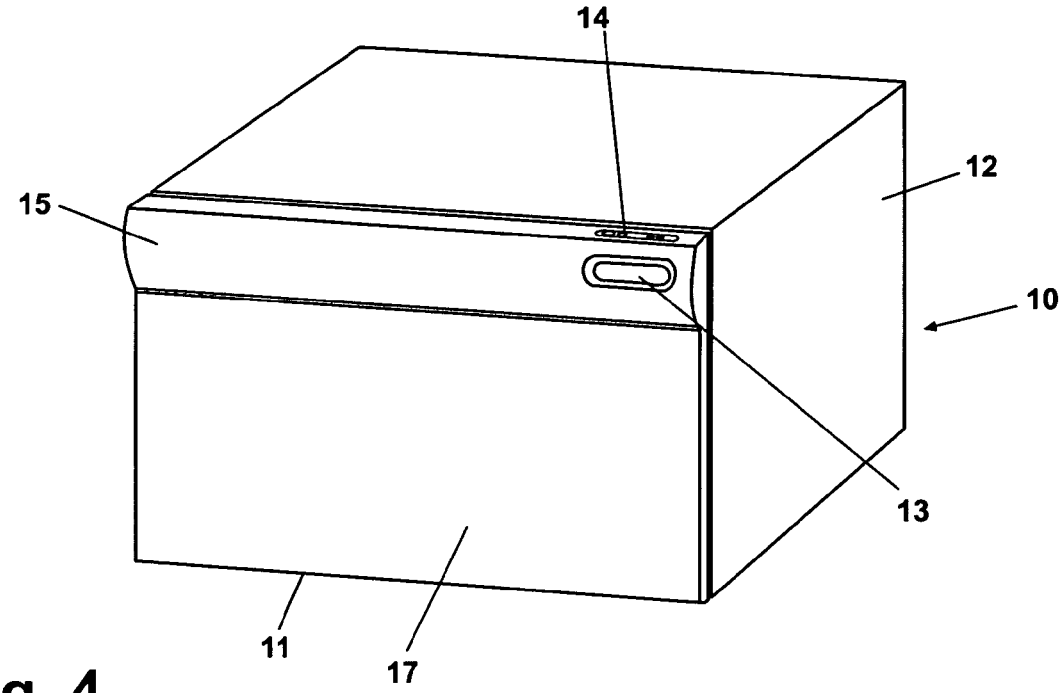
FIG. 4 is a perspective view of a drawer appliance according to the invention removed from a counter unit.
Figure 6:
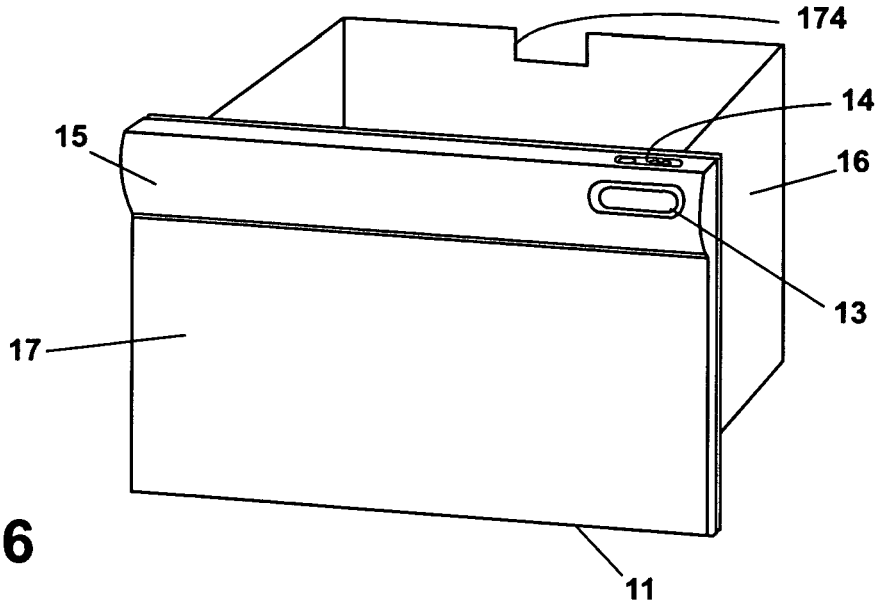
FIG. 6 is a perspective view of the drawer of the drawer appliance of FIG. 4 removed from the drawer appliance cabinet.

Turning to FIG. 4 and FIG. 6, a drawer appliance 10 according to the invention can be seen removed from a counter unit. Drawer appliance 10 can be configured to function as a refrigerator, a freezer, and ice drawer or a warming drawer as will be explained in detail below. Drawer appliance 10 can include a drawer 11 slidably mounted in a drawer appliance cabinet 12. Drawer 11 can include a drawer front 17 and a bin 16 attached to the drawer front 17. The front of drawer 11 can include a display 13 arranged to display the temperature inside the drawer and/or the set point temperature and whether the drawer appliance is turned on or off. Those skilled in the art will understand that display 13 can be arranged to display other information about the operation of the drawer appliance as is well known in the art. Drawer 11 can also include a user interface 14 that can be arranged on the top edge of drawer 11. User interface 14 can include control surfaces to allow the user to turn the drawer appliance on and off and adjust the temperature in the drawer. A portion 15 of the drawer front can be arranged to provide a handle for gripping the drawer to open and close the drawer. Handle 15 can include an undercut portion, not shown to allow a user to grip the handle. Those skilled in the art will understand that another form of handle can be provided on the front of drawer 11 to facilitate opening and closing of drawer 11 as desired.

Figure 5:
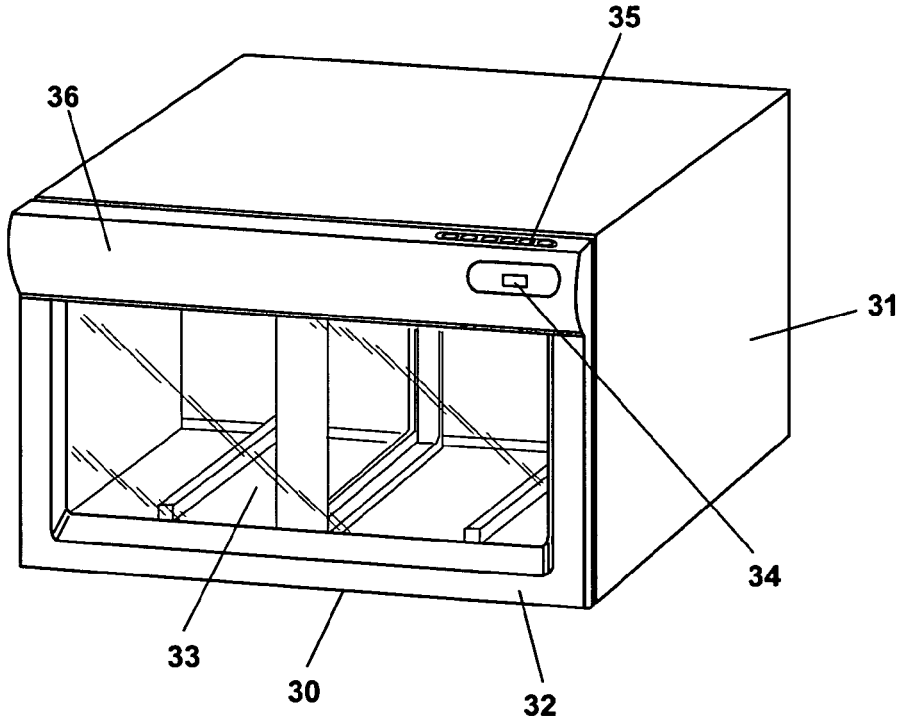
FIG. 5 is a perspective view of another embodiment of a drawer appliance according to the invention removed from a counter unit.
Figure 7A:
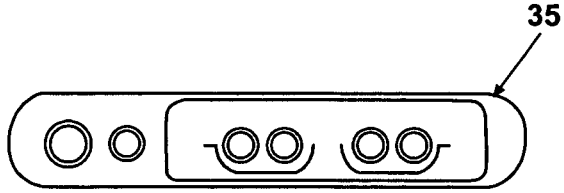
FIG. 7A is a view showing the layout of a user interface for the drawer of FIG. 7.
Figure 7:
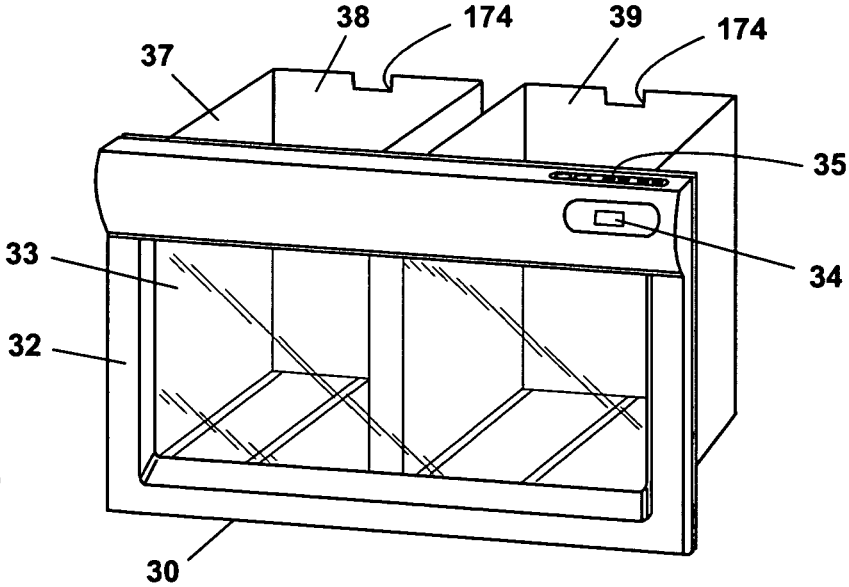
FIG. 7 is a perspective view of the drawer of the drawer appliance of FIG. 5 removed from the drawer appliance cabinet.

Turing to FIG. 5 and FIG. 7, a two temperature refrigerated drawer appliance can be seen removed from a counter unit. In the embodiment shown in FIG. 5 and FIG. 7, drawer 30 can be slidably carried in cabinet 31. Drawer 30 can include a drawer front 32 having a transparent window 33 that can allow a user to view the contents of the wine chilling drawer 30. Drawer front 32 can include a display 34 and a user interface 35. Display 34 can be arranged to display whether the drawer appliance is on or off and can display the temperatures in the compartments. Drawer 30 can include a bin 37 forming two compartments 38 and 39. Compartments 38 and 39 can be spaced as shown in FIG. 7 to provide a space for an insulated mullion 40 between compartments 38 and 39 to allow the compartments to be operated at different temperatures if desired, see FIG. 23 and 24.

Figure 8:
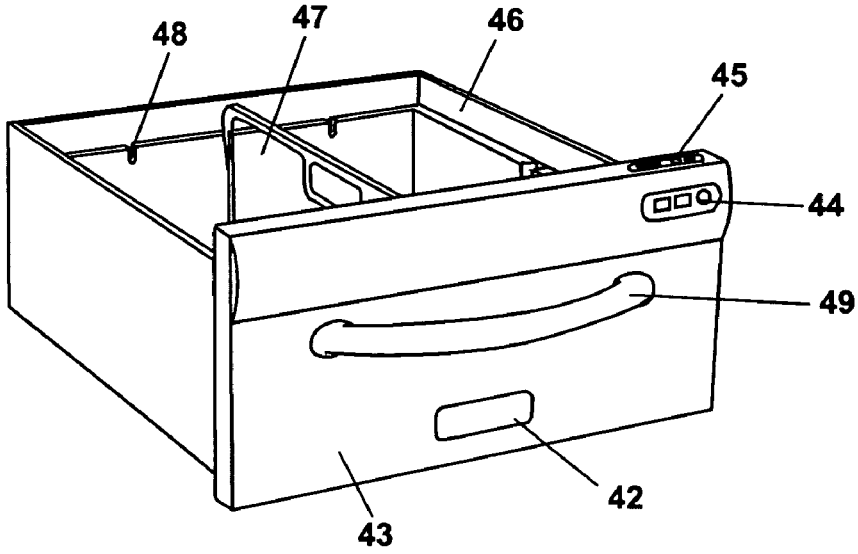
FIG. 8 is a perspective view of another embodiment of a drawer according to the invention removed from a drawer appliance cabinet.

Turning to FIG. 8, another embodiment of a drawer 42 can be seen removed from a drawer appliance. Drawer 42 can be used in a drawer appliance that is configured for use as a refrigerator, a freezer, an ice drawer, or a warming drawer as will be explained in greater detail below. Drawer 42 can have a drawer front 43 that can have a display 44 and user interface 45 to allow a user to control the drawer appliance and determine the on/off and temperature inside the drawer as in the prior embodiments. Drawer 42 can have a bin 46 arranged to support a divider 47 in a plurality of positions. Bin 46 can have a plurality of notches 48 arranged around the periphery of bin 46 to support divider 47 in different locations in drawer 42. Bin 46 and divider 47 can be dimensioned so that divider 47 can be positioned front to back as shown in FIG. 8, or can be arranged side to side as desired by the user to optimize the storage space. Drawer 42 can have a handle 49 mounted to the drawer front 43. Those skilled in the art will understand that a handle like handle 49 can be used on other drawer embodiments disclosed in this application, and that, if desired, an undercut handle 15 as in FIG. 2 through FIG. 7 can be used on the embodiment of FIG. 8.

Figure 9:
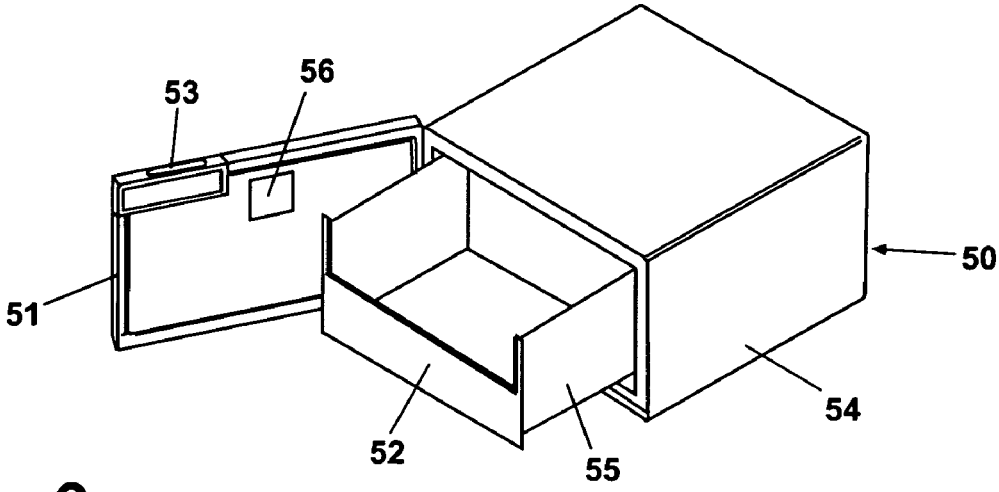
FIG. 9 is a perspective view of another embodiment of a drawer according to the invention withdrawn from a drawer appliance cabinet.

Turning to FIG. 9 another embodiment of a drawer appliance can be seen removed from a counter unit. Drawer appliance 50 can include an insulated side hinged door 51 hingedly mounted by suitable hinges, not shown, to the front of insulated cabinet 54. A drawer 52 can be slidably mounted in cabinet 54 to provide ready access to the contents of drawer 52. Door 51 can include a user interface 53 and a display, not shown, on the front of door 51. The inside surface of door 51 can include a light fixture 56. Those skilled in the art will understand that light fixture 56 can be located inside the cabinet on a side wall or top wall instead of on the inside surface of door 51. The user interface 53 and display can be arranged to allow a user to select the operating conditions of the drawer appliance to determine the operating conditions in the drawer appliance. As in the case of the other drawer appliances described above, drawer appliance 50 can be configured to be a refrigerator, a freezer, an ice drawer or a warming drawer. While bin 55 is shown as a single bin those skilled in the art will understand that a two compartment bin can be used in the embodiment of FIG. 9 if desired to provide two storage temperatures as in the case of the wine drawer appliance described above.

Figure 10:
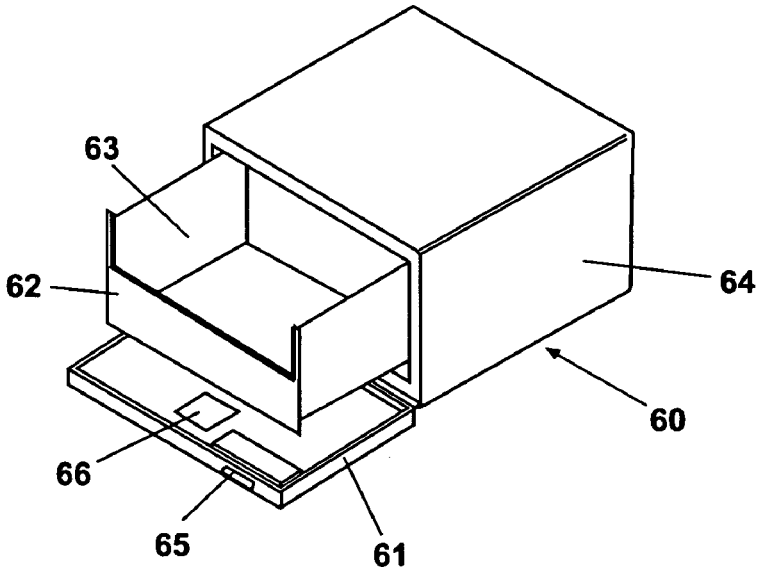
FIG. 10 is a perspective view of another embodiment of a drawer according to the invention withdrawn from a drawer appliance cabinet.

Referring to FIG. 10, another embodiment of a drawer appliance can be seen removed from a counter unit. Drawer appliance 60 can include an insulated drawer front 61 hingedly mounted to the bottom edge of cabinet 64 by suitable hinges, not shown. A drawer 62 can be slidably mounted in insulated cabinet 64 for movement between withdrawn and closed positions. Drawer front 61 can include a user interface 65 and a user display, not shown, on the front of the drawer front 61. As with the embodiment of FIG. 9, drawer 62 can include a bin 63. The inner surface of door 61 can include a light fixture 66 if desired. As in the embodiment of FIG. 9, light fixture 66 could be located in the cabinet on a side wall or on the top wall instead of the inside surface of door 61. While bin 63 is shown as a single compartment, bin 63 can be arranged to be a two compartment bin as in the case of the embodiment of FIG. 5 and FIG. 7. Drawer appliance 60 can be configured to be a refrigerator, freezer, ice drawer or warming drawer as discussed above. Likewise, bin 63 can be a two compartment bin like the embodiment of FIG. 5 and FIG. 7 for applications providing two storage temperatures such as the wine drawers described above.

Turning now to FIG. 11 through FIG. 21 the method of manufacturing a base cabinet unit 99 (FIGS. 20 and 21) for a drawer appliance will be described. The base cabinet unit according to the invention can be used with any of the drawers described in this application. In this respect, the drawer appliance is modular in that the base cabinet unit 99 described in the following paragraphs can be fabricated without knowing which type of drawer appliance and which drawer will be combined with the base cabinet unit to form a drawer appliance. The overall dimensions base cabinet unit embodiment disclosed in FIGS. 11 through 21 can be 23.88" wide, 14.90" high and 24.89" deep. Those skilled in the art will understand that the overall dimensions can be adjusted as desired to fit known counter unit dimensions, or to achieve desired free standing dimensions in the case of a drawer appliance that can be free standing as shown in FIG.

34. Further, the drawer appliance according to the invention can be made in a series of sizes for example drawer appliances could be provided with width or height dimensions in 3" increments, 21 ", 24", 27" and so on.

Figure 11:
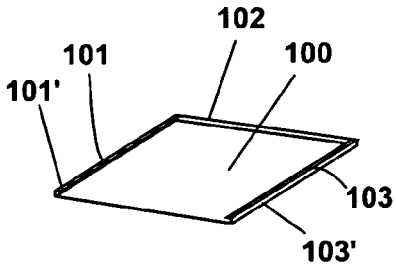
FIG. 11 is a perspective view of a base for a drawer appliance cabinet according to the invention.
Figure 12:
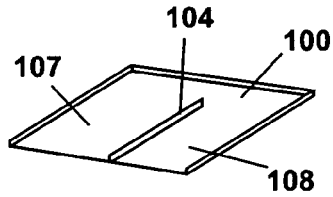
FIG. 12 is a perspective view of the base of FIG. 11 with a middle divider attached to the base.
Figure 13:
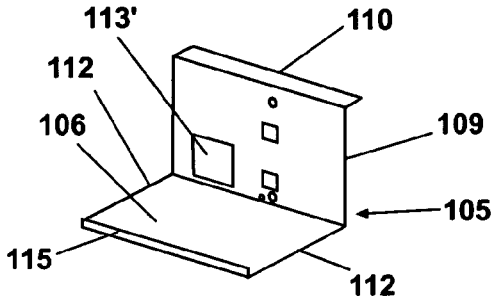
FIG. 13 is an upper perspective view of a Z bracket for a drawer appliance cabinet according to the invention.

A cabinet base 100 according to the invention can be seen in FIG. 11. Base 100 can be dimensioned to define the foot print of the drawer appliance and can include flanges 101–103 turned up on the side and rear edges of base 100. Flanges 101 and 103 can have a horizontal leg 101' and 103' at the top edge of the upwardly extending flange 101 and 103 respectively. Base 100 and flanges 101–103 can have suitable holes provided for fasteners used to mount cabinet components and cabinet parts to base 100. Base 100 can be fabricated sheet metal such as galvanized steel. Base 100 can be pre-painted if desired, but since the drawer appliance is intended to be a built in product a galvanized finish need not be decoratively coated. As shown in FIG. 12 a divider 104 can be attached to base 100. Divider 104 can extend from the front edge of base 100 toward the rear of base 100 to define air flow passages between base 100 and a separator or Z bracket 105 shown in FIGS. 13 and 14. Divider 104 can extend toward the rear of base 100 substantially as far as bottom leg 106 of Z bracket 105 to define air passages 107 and 108. Divider 104 can be fabricated sheet metal like base 100 and can be welded or otherwise attached to base 100.

Figure 14:
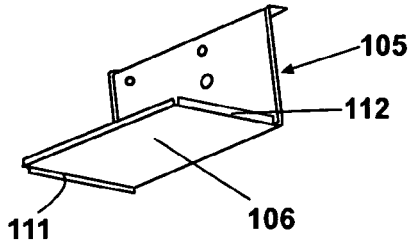
FIG. 14 is a lower perspective view of the Z bracket of FIG. 13 with a channel for wires leading to an on/off switch attached to the Z bracket.
Figure 15:
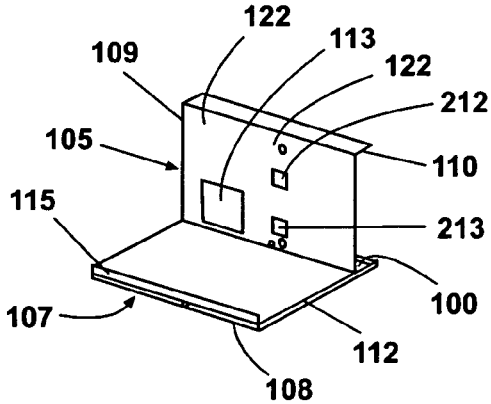
FIG. 15 is a perspective view of the Z bracket of FIG. 14 attached to the base of FIG. 12.

Separator or Z bracket 105 can include a vertical wall 109 and a top leg 110. Z bracket 105 can also include upwardly extending flanges 112 on the edges of bottom leg 106. An upwardly extending flange 115 can be provided on the front edge of bottom leg 106 to retain a liner breaker strip as will be described below. The horizontal extension of bottom leg 106 plus top leg 110 can substantially match the depth of base 100. Z bracket 105 can be fabricated sheet metal such as galvanized steel as in the case of the base 100 and divider 104. As shown in FIG. 14, a channel 111 can be attached to the underside of bottom leg 106 at one edge of Z bracket 105 to provide a passage for wires from a machine compartment 130 (see FIG. 21) behind vertical wall 109 to the front of base 100 for an on/off switch as will be described in more detail below. As shown in FIG. 15, two electrical connectors 212 and 213 attached to a wiring harness 210 (see FIG. 17A) can be attached in vertical wall 109 to facilitate connection of wiring harnesses between the machine compartment 130 through the insulation space between vertical wall 109 and rear wall 121 of liner 116. Vertical wall 109 can include a cover 113 for opening 113' to provide a recess to provide adequate space for a compressor in the machine compartment as will be described in more detail below. Separator or Z bracket 105 can be attached to base 100 by suitable fasteners connecting bottom leg 106 of Z bracket 105 to flanges 101' and 103' of base 100. Pop rivets, not shown, can be used as fasteners to connect Z bracket 105 to base flanges 101' and 103'. Those skilled in the art will understand that other fasteners such a screws or clips can be used in lieu of pop rivets to attach Z bracket 105 to base 100. While base 100, divider 104 and separator or Z bracket 105 are described above as being fabricated of galvanized steel, those skilled in the art will understand that other coated or non-coated sheet material such as aluminum and cold rolled steel can be used as desired.

Figure 16:
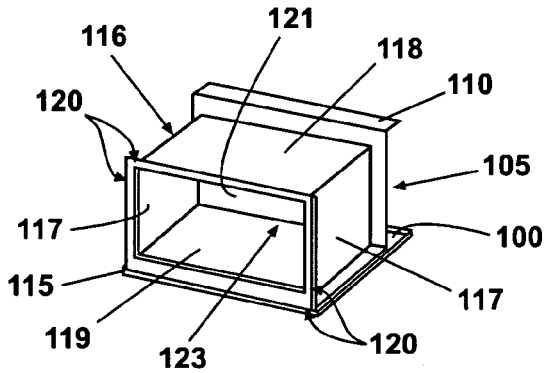
FIG. 16 is a perspective view of a liner according to the invention positioned on the Z bracket and base shown in FIG. 15.
Figure 17:
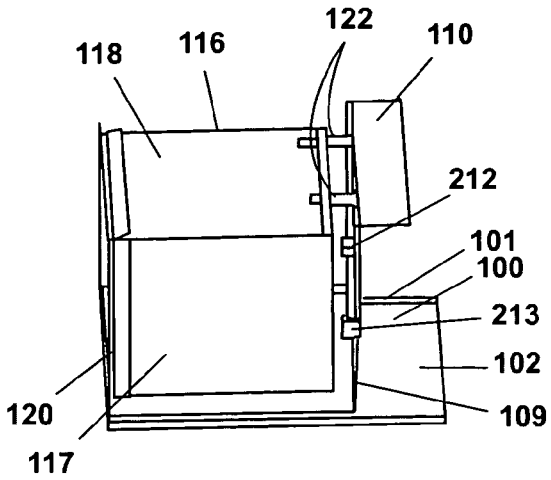
FIG. 17 is a side perspective view of the liner positioned on the Z bracket and base shown in FIG. 16 showing the spacing between the liner and the Z bracket and the relationship between the Z bracket and the base.
Figure 19:
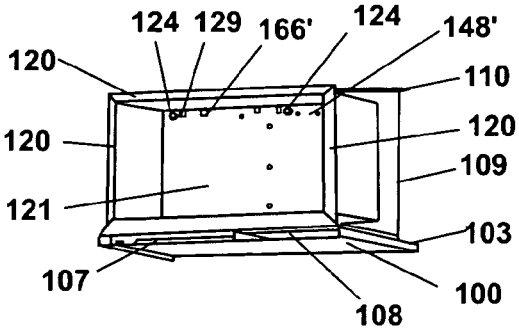
FIG. 19 a front perspective view of the assembly shown in FIG. 16 showing the position of connectors and passages in the rear wall of the liner.
Figure 18:
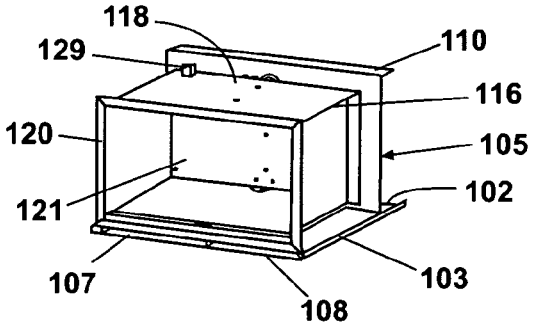
FIG. 18 is a front perspective of the assembly shown in FIG. 16 with a light switch installed on the liner.

Referring to FIG. 16 and FIG. 17, a liner 116 can be positioned on the Z bracket 105. Liner 116 can be formed of folded sheet material that can have opposing side walls 117, a top wall 118 and a bottom wall 119. The front edge of liner 116 can be formed to retain a plurality of breaker strips 120 that can extend from the edge of liner 116 to the wrapper, see FIG. 20, and to flange 115 in Z bracket 105. Breaker strips 120 can be formed of thermally non-conductive material and can provide a thermal break between the outside surfaces of the drawer appliance and the liner 116 as is well known in the art. Liner 116 can also include a back wall 121 that can be attached to the side walls 117, top wall 118 and bottom wall 119 prior to assembly of liner 116 to the drawer appliance. Liner 116 can be formed of sheet metal such as pre-painted steel, pre-painted aluminum or stainless steel, or can be fabricated of vacuum formed or injection molded plastic material as is well known in the art. If liner 116 is fabricated of plastic material breaker strips 120 can be formed integrally with liner 116 as is well known in the art. Liner 116 can be provided with holes for fasteners for attachment of internal elements or to receive connectors for electrical elements as is well known in the art, and described in greater detail below. A pair of spacers 122 can be mounted to vertical wall 109 of Z bracket 105 to support liner 116 spaced from vertical wall 109. Spacers 122 can be hollow insulating members to provide thermal insulation between liner 116 and vertical wall 109 of Z bracket 105. Spacers 122 can also provide openings 124 (see FIG. 19) from the machine compartment 130 (see FIG. 22) to the interior of liner 116. The breaker strip 120 positioned between bottom wall 119 and flange 115 on Z bracket 105 can vertically support liner 116 while wrapper 125 is installed and foam in place insulation is injected into the spaces between liner 116, Z bracket 105 and wrapper 125. A drain 123 can be positioned in bottom wall 119 adjacent back wall 121 to drain any liquid that might collect in liner 116 and convey the liquid to the machine compartment 130 as described below. Referring to FIGS. 18 and 19, a light switch 129 can be provided in top wall 118 adjacent the rear of liner 116. Light switch 129 can be connected to the drawer appliance control to control operation of the drawer appliance when a drawer is opened and, if desired, to energize lights for the interior of the drawer when the drawer is opened.

Figure 17A:
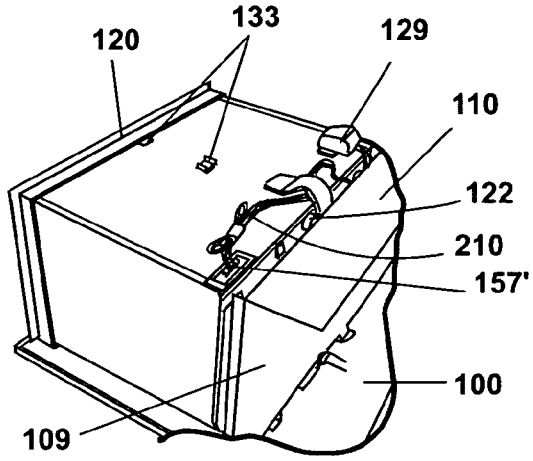
FIG. 17A is a partial side perspective view of liner positioned on the Z bracket and base showing a wiring harness installed.

Referring to FIG. 17A, a foamed in place wiring harness 210 can be seen installed in the space between liner 116 and vertical wall 109 of Z bracket 105. Wiring harness 210 can be connected to door switch 129 and to a plurality of connectors 166', 148' and 157' located in liner 116. Also shown in FIG. 17A are a plurality of clips 133 that can receive screws used to mount elements inside liner 116 as will be described below. Clips 133 can be attached to liner 116 to provide secure mounting points. Those skilled in the art will understand that clips 133 can be positioned on liner 116 at any location desired to provide a mounting point for an element inside liner 116.

Figure 20:
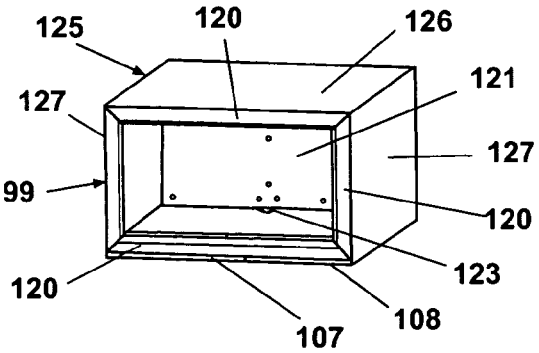
FIG. 20 is a front perspective view of a drawer appliance cabinet according to the invention with a wrapper assembled.
Figure 21:
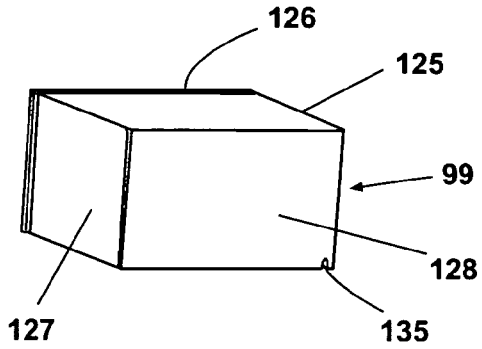
FIG. 21 is a rear perspective view of the drawer appliance of FIG. 20 with a back cover installed.

Referring to FIG. 20, a wrapper 125 having a top wall 126 and side walls 127 can be positioned over the liner 116 positioned on Z bracket 105. Breaker strips 120 engage the side walls 127 and top wall 126 of wrapper 125. The bottom edges of side walls 127 can be fastened to base 100 with suitable fasteners such a pop rivets, not shown. As with attachment of Z bracket 105 to base 100, wrapper 125 can be attached to base 100 with other known fasteners as will be readily understood by those skilled in the art. As in the case of the base 100 and Z bracket 105, wrapper 125 can be fabricated of other sheet material such as pre-coated or non-coated sheet metal including cold rolled steel and aluminum, or can be fabricated of sheet plastic material all as well known in the art. Following installation of wrapper 125 the appliance cabinet can be insulated by injecting foam insulation as is well known in the art. For example, urethane insulation typically used for household refrigerators can be injected into the space between liner 116, Z bracket 105 and wrapper 125 through a foaming hole 156 (see FIG. 22) while the assembled cabinet is held in a foam fixture all as well known in the art. Referring to FIG. 21, when assembly of the drawer appliance is complete a back wall 128 can be fastened to the wrapper 125 and base 100. Removable fasteners such a screws can be used to fasten back wall 128 to the wrapper and base to provide access to the machine compartment 130 for service if required. A power cord 135 can extend from back wall 128 to connect the drawer appliance to the household electrical system. When wrapper 126 is fabricated sheet metal such as galvanized steel a front trim element, not shown, can be added at the front edge to provide a decorative edge should the cabinet wrapper protrude from a counter unit when installed. Once the assembly steps described above are complete and insulated, the base cabinet unit 99 is complete and can be assembled for use with any of the drawer configurations disclosed in this application. If desired, base cabinet units 99 can be produced to this point and stored until an order is received for a particular configuration drawer appliance. Each of drawer appliance cabinets 12, 31, 31', 54, 64, 169, 179, 189 and 195 described herein can include a base cabinet unit 99.

Figure 22:
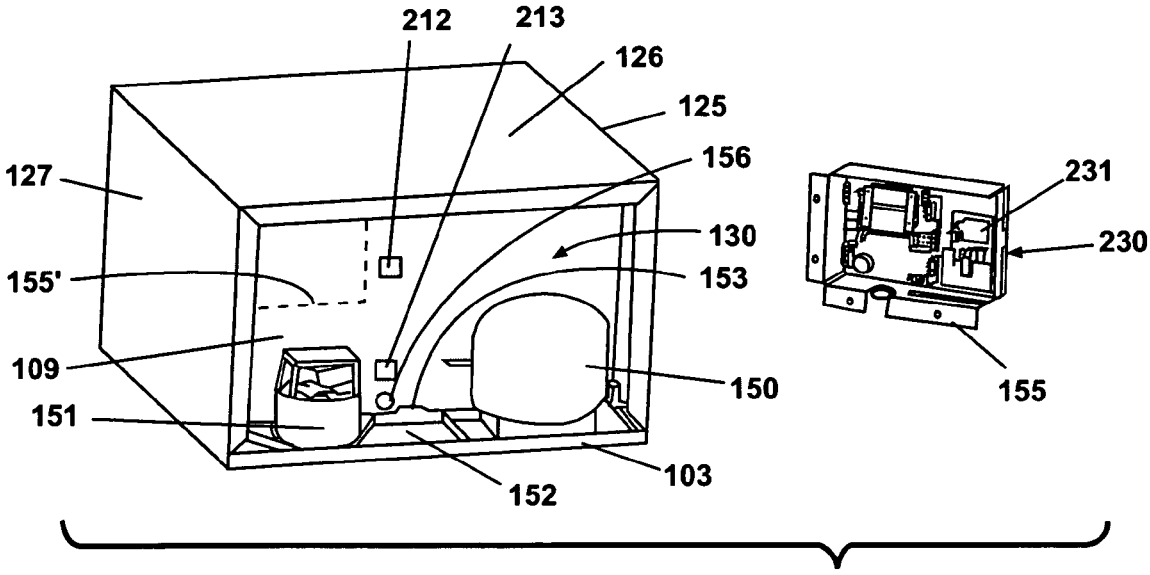
FIG. 22 is a rear perspective view of one embodiment of drawer appliance with a compressor and condenser fan installed in the machine compartment.

Next completion of base cabinet units and construction of drawers for different embodiments of drawer appliances will be described. Turning to FIG. 22, a machine compartment 130 of a base cabinet unit intended for use as a refrigerating drawer appliance can be seen. A compressor 150 can be mounted to base 100 using suitable fasteners, not shown. As mentioned above compressor 150 can extend into recess 113' in vertical wall 109. As also mentioned above, vertical wall 109 can include connectors 212 and 213 to connect wiring harness 210 positioned in the foam in place insulation to wiring harness 215 in the machine compartment (see FIG. 40). A condenser, not shown can be positioned in air passage 107 with lines, not shown, leading to compressor 150. A condenser fan 151 and drip pan 152 can be positioned in machine compartment 130 adjacent compressor 150 and mounted to base 100 using suitable fasteners, not shown. A grommet 153 can be provided in vertical wall 109 adjacent base 100 prior to injection of the foam in place insulation to provide a passage for drain line 154 leading from drain 123 in the bottom wall 119 of liner 116 (see FIG. 29). Drain line 154 can discharge water or other liquid from inside liner 116 into drip pan 152 for evaporation. Condenser fan 151 can be arranged to draw air into passage 107, over the condenser, not shown, through condenser fan and discharge the air out air passage 108 leading to the front of the drawer appliance. A control box 155, shown removed from vertical wall 109 can be provided in machine compartment 130 for the drawer appliance control described below. Control box 155 can be located on vertical wall 109 as indicated by dashed lines 155'.

Figure 23:
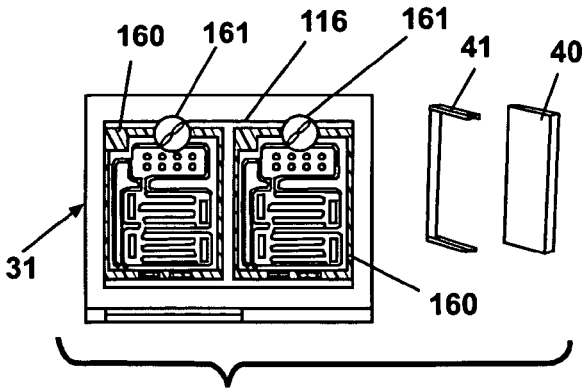
FIG. 23 is a partial exploded front view of one embodiment of a drawer appliance according to the invention having two evaporators and a divider wall forming two refrigerated compartments.
Figure 23A:
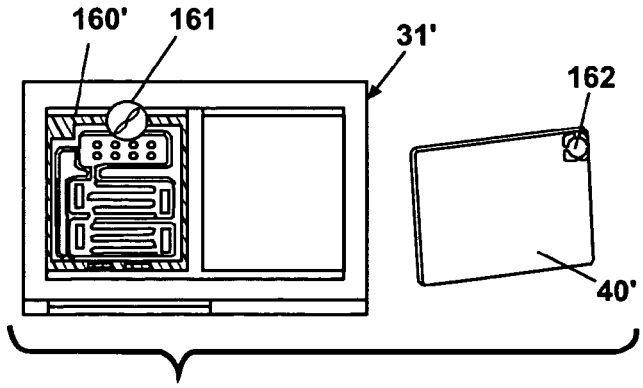
FIG. 23A is a partial exploded front view of another embodiment of the drawer appliance according to the invention have a single evaporator and a divider wall having a circulation fan for forming two refrigerated compartments.
Figure 24:
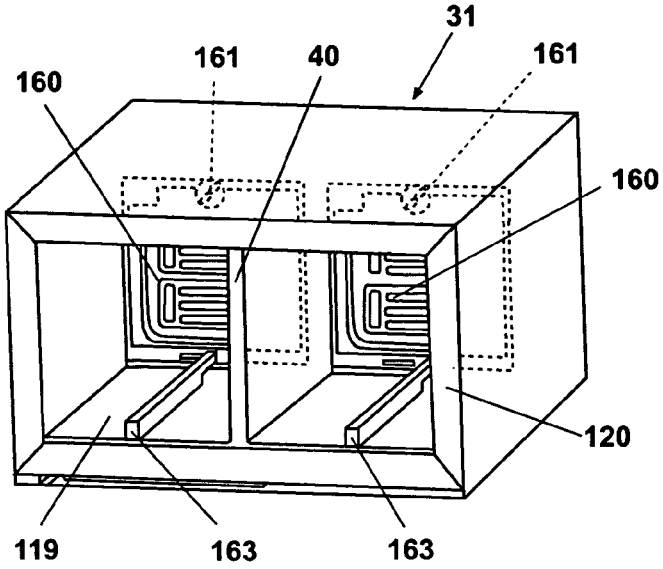
FIG. 24 is a front perspective view of the drawer appliance embodiment shown in FIG. 23.

Completion of a base cabinet unit 99 to be a two temperature refrigerated drawer appliance 20 can be understood by referring to FIG. 5, FIG. 7 and FIGS. 23 through 28. As mentioned above, a two temperature refrigerated drawer appliance 20 according to the invention can be arranged to have two storage compartments that can be operated at different temperatures. For example it may be desirable to store different wines at different temperatures depending on the taste of the user. While it may be desirable to chill both red wine and white wine or champagne, it may be desirable to maintain red wine at a higher temperature for serving than white wine or champagne. The two temperature refrigerated drawer appliance will be described as a wine drawer appliance. However, those skilled in the art will understand that a two temperature refrigerated drawer appliance can be used for any desired refrigerated drawer configuration for which different operating temperatures are desired for the two compartments. Turning to FIG. 23, wine drawer cabinet 31 can be seen with wine drawer 30 removed. A mullion 40 is also shown removed from liner 116. Mullion 40 can be an insulated panel held in liner 116 by mullion channel 41 also shown removed from liner 116. Mullion channel 41 can be attached to liner 41 by suitable fasteners such as screws, not shown, that can be driven into clips 133 attached to the outside surface of the liner 116, (see FIG. 17A). Those skilled in the art will understand that mullion channel 41 can be fastened in liner 116 by other fasteners as are well known in the art. Mullion 40 can be formed of an insulating material such as a urethane foam or styrobead panel covered with plastic or metal sheet material as is well known in the art. In the embodiment of a wine drawer appliance 30 shown in FIG. 23 and 24 two evaporators 160 can be mounted adjacent back wall 121 separated by mullion 40. The evaporators 160 can be mounted adjacent back wall 121 using suitable fasteners as are well known in the art. As with the mullion channel, screws can be driven into clips 133 attached to the outside surface of liner 116. In the embodiment of FIGS. 23 and 24 evaporators 160 can be rollbond evaporators that are well known in the art. Rollbond evaporators 160 may be mounted spaced from back wall 121 to allow air to flow over both surfaces of the evaporators 160. For example rollbond evaporators can be spaced ½" from back wall 121. Those skilled in the art will understand that a tube and fin evaporator can be used instead of a rollbond evaporator, if desired. An evaporator fan 161 can be mounted at the top of each evaporator 160 for circulating refrigerated air in each compartment 38 and 39. Evaporator fans 161 can be mounted to rear wall 121 and connected to the foamed in place wiring harness connector positioned in liner 116 at or adjacent each evaporator fan location. Each evaporator can have refrigerant lines, not shown, that pass through openings 124 in spacers 122 into the machine compartment 130 for connection to the compressor 150. As will be discussed in more detail below, when two evaporators 160 are used for a wine drawer each evaporator can be connected to compressor 150 through a suitable refrigerant valve, not shown, to allow selective operation of the evaporators. Slides 163 can be provided on bottom wall 119 to slidably support drawer 30 in cabinet 31, and can be fastened to bottom wall 119 with suitable fasteners, not shown, that can be driven into clips 133 attached to the outside surface of liner 116. Quick release clips, not shown, can be used to attach drawer 30 to slides 163. A two compartment wine drawer appliance 31' can be cooled using a single evaporator 160' on the left side of liner 116, see FIG. 23A. Mullion 40' can have a mullion fan 162 positioned in the upper rear corner for circulating refrigerated air from evaporator 160' in the right compartment.

Figure 25:
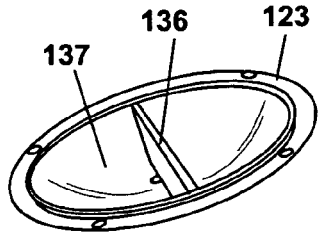
FIG. 25 is a partial perspective view of a drain according to the invention removed from the bottom wall of the liner.
Figure 26:
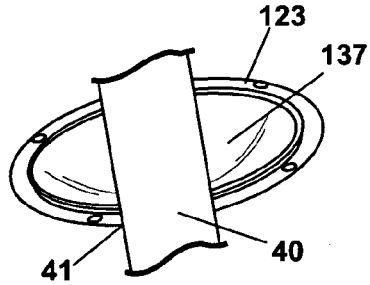
FIG. 26 is partial perspective view of a drain according to the invention removed from the bottom wall of a liner of a two compartment drawer appliance embodiment as shown in FIG. 23 and FIG. 23A.

Referring to FIG. 25 and FIG. 26, drain 123 shown removed from bottom wall 119, can have a drain divider 136 that extends from the curved bottom wall 137 to the plane of the top surface of drain 123. Drain 123 can be installed in bottom wall 119 of liner 116 along the center line of mullion 40 so that when mullion channel 41 and mullion 40 are installed air from the two adjacent compartments can not flow through drain from one compartment to the other compartment, thus effectively isolating the two compartments.

Figure 27:
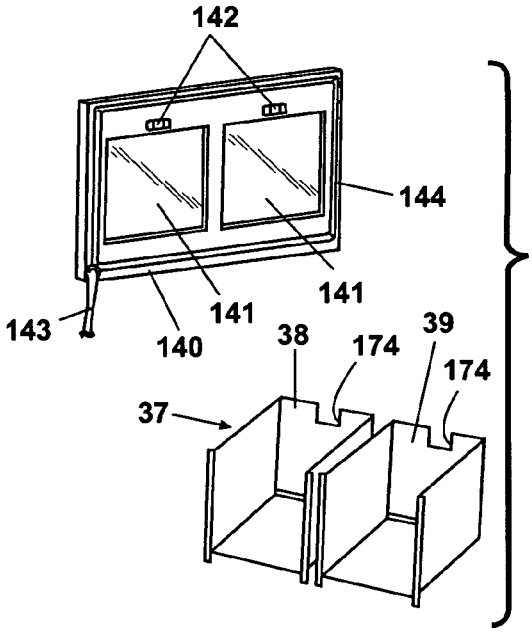
FIG. 27 is a rear perspective view of a drawer front according to the invention for use with the embodiment of FIG. 24 removed from the drawer.
Figure 28:
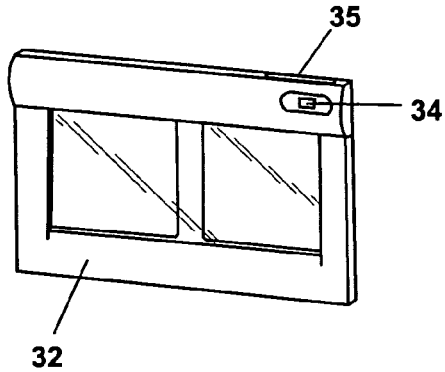
FIG. 28 is a front perspective view of the drawer front of FIG. 27.

Referring to FIG. 7, FIG. 27 and FIG. 28, the construction of a two temperature refrigerated drawer 30 that can be a wine drawer can be seen. Back plate 140 for the drawer front can have two openings to form windows for the two compartments. An insulated window 141 can be positioned covering the two openings in back plate 140. Window 141 can be an insulated glass panel or can be a transparent insulated plastic panel as is well known in the art. While a single insulated window overlying both openings is shown in the embodiment of FIG. 5, FIG. 7 and FIG. 28, those skilled in the art will understand that two insulated windows can be provided. Back plate 140 can also include openings to receive light fixtures 142 to provide light in each compartment of the two-temperature drawer. Light fixtures 142 can be LED light fixtures or other low voltage light fixtures known in the art. A communication cable 143 can lead from one edge of back plate 140 to a connector, not shown, in liner 116. Cable 143 can include leads to light fixtures 142, display 34 and user interface 35. Front panel 32 can include a receptacle or receptacles, not shown for display 34 and user interface 35. Back panel 140 can include a receptacle or receptacles for light fixtures 142. The receptacle(s) can include a grommet, not shown, to receive leads from the communication cable 143 for the respective components. Following assembly of the receptacles and a handle, if any as in the FIG. 8 embodiment, to drawer front 32, drawer front 32 and back plate 140 can be assembled and foam in place insulation can be injected to form an insulated drawer front through a foam hole, not shown, as is well known in the art. Fasteners such as screws, not shown, can be used to attach back plate 140 to drawer front 32. Drawer front 32 can have screw anchors to receive screws, not shown, that can be positioned around the perimeter of back plate 140 to fasten back plate 140 to drawer front 32. Those skilled in the art will understand that alternate, well known devices including brackets and retainers could be provide to receive screws, or other fasteners to fasten back plate 140 to drawer front 32. The screws can be covered by a drawer gasket 144 assembled to back plate 140. In the embodiment of FIG. 27 gasket 144 can include a dart on the rear surface of the gasket that can be pushed into a channel, not shown, on the surface of back plate 140. The screws, not shown, fastening back plate 140 to drawer front 32 can be positioned in the channel to be covered by gasket 144. Drawer front 32 and back plate 140 can be fabricated of sheet material such as pre-coated steel, stainless steel or plastic material.

Following insulation of the drawer front, bin 37 having compartments 38 and 39 can be attached to the drawer front assembly. Bin 37 can be fabricated of sheet material such as pre-painted aluminum or steel, stainless steel, cold rolled steel or plastic material. If bin 37 is fabricated of cold rolled steel bin 37 can be appropriately finished prior to assembly. Those skilled in the art will understand that bin 37 can be vacuum formed or injection molded if it is desired to form bin 37 from plastic material. Bin 37 can be attached to the back plate 140 using suitable fasteners, not shown. If desired, clips 133 can be attached to the inside surface of back plate 140 to receive screws for mounting bin 37 to back plate 140. Light fixtures 142, the display 34 and user interface 35 can be connected to terminals, not shown, on communication cable 143 and pressed or snapped into their respective receptacle, not shown, to mount the light fixtures, display and user interface to wine drawer 30. Those skilled in the art will understand that light fixtures 142, the display 34 and user interface 35 can be assembled to the two temperature drawer either before or after bin 37 is attached to the drawer front. Bin 37 can include holes in the back of the bin on the rear or bottom wall to engage hooks, not shown, positioned on the back end of slide 163. Quick connect clips, not shown, can be mounted to the underside of bin 37 adjacent the front edge of bin 37 to engage the front end of slides 163. The completed two temperature drawer 30 can be assembled to a cabinet as shown in FIG. 24 by connecting the communication cable 143 to a connector, not shown, on rear wall 121 and positioning drawer 30 on slides 163 so that the hooks, not shown, on the back end of slides 163 engage in the holes, not shown, in the back of bin 37 and then pressing drawer 30 down onto slides 163 to allow the quick connect clips, not shown, to engage slides 163 and lock drawer 30 on slides 163. To remove drawer 163 a user can release the quick connect clips and lift drawer 30 off slides 163 by sliding drawer 30 outward so that the hooks, not shown, on the back end of slides 163 disengage from the holes, not shown in the back of bin 37.

Figure 29:
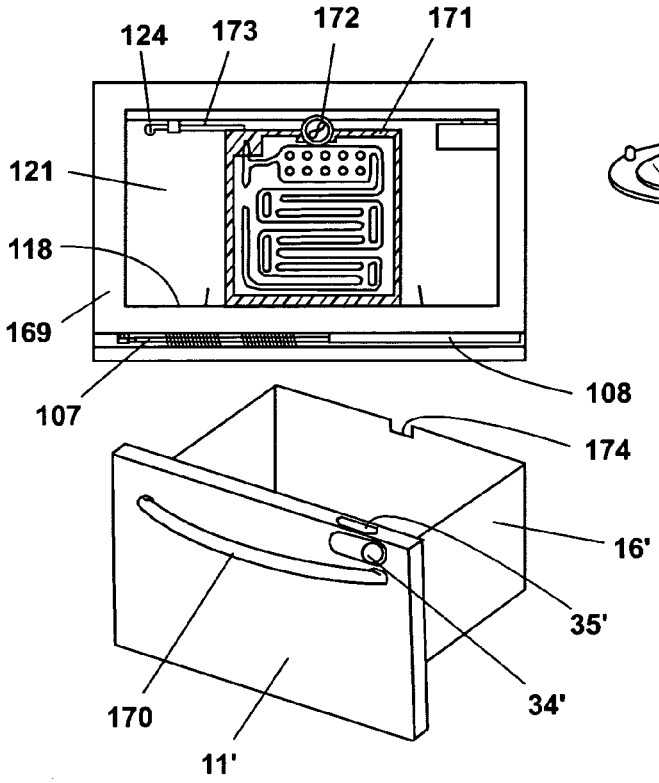
FIG. 29 is a partial exploded front view of another embodiment of the drawer appliance according to the invention with the drawer removed and shown in perspective.
Figure 29:
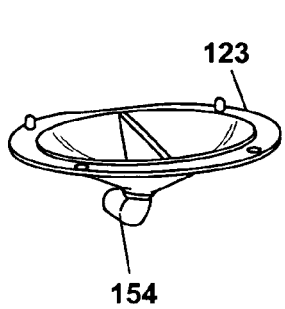
Figure 30:
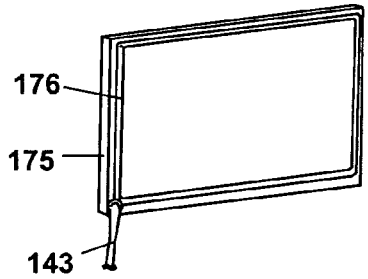
FIG. 30 is a rear perspective view of a drawer front according to the invention for use with the embodiment of FIG. 29 with the bin removed from the drawer.
Figure 31:
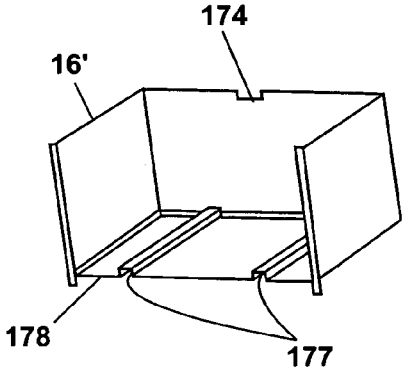
FIG. 31 is a perspective view of the bin for the drawer shown in FIG. 29.
Figure 29A:
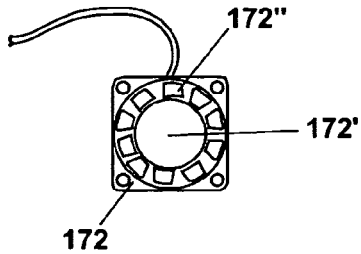
FIG. 29A is a front view of an evaporator fan removed from a drawer appliance according to the invention.

Turning to FIG. 4, FIG. 6 and FIGS. 29 to 31 the construction of a refrigerator or freezer drawer appliance 10 can be seen. Refrigerator or freezer drawer appliance 10 can include a cabinet 169 and a refrigerator or freezer drawer 11 (FIG. 4 and FIG. 6) or drawer 11' (FIG. 29). The refrigerator or freezer drawers 11 and 11' can be constructed in the same manner and differ in the handle (15 on drawer 11 and 170 on drawer 11'). Cabinet 169 can be a base cabinet unit 99 and can include an evaporator 171 mounted to rear wall 121 as in the case of the two temperature drawer embodiment described above. Evaporator 171 can be a rollbond evaporator well known in the art. An evaporator fan 172 can be mounted adjacent the top of evaporator 171 to circulate refrigerated air in the cabinet 12. One example of evaporator fans 161, 162 and 172 that can be used in the refrigerated drawer appliance embodiments described in this application can be seen removed from cabinet 169 in FIG. 29A. Evaporator fans 161, 162 and 172 can each include a motor 172' and a fan blade 172" driven by motor 172'. Also shown in FIG. 29 are refrigerant lines 173 leading from evaporator 171 to opening 124 in spacer 122 leading to the machine compartment 130 and compressor 150. Refrigeration lines for the evaporators in the other refrigerating embodiments similarly lead to one or the other of openings 124 leading to the machine compartment 130 and compressor 150. Refrigerator or freezer drawer 11' can have a notch 174 in the rear wall of the bin 16' that can be positioned to line up with evaporator fan 172 to facilitate flow of refrigerated air in bin 16'. A notch 174 can be provided in bins for other configuration drawer appliances as well as shown in FIGS. 6, 7, 27, 31, 32, 33, 43 and 44. A back plate 175 can be assembled to drawer front 11' as described above for drawer 30 after handle 170, communication cable 143 and receptacles for display 34' and user interface 35' as described above in the case of drawer 30 are installed. After back plate 175 and drawer front 11' are assembled foam in place insulation can be added as described above. Gasket 176 can be pushed into a channel, not shown, on the surface of back plate 175 as in the embodiment of FIG. 27. Bin 16' can be formed of sheet material as described above with respect to bin 37. Bin 16' can be assembled to back plate 175 as described above for wine drawer 30. Referring to FIG. 31, an alternate embodiment refrigerator or freezer bin 16' can include channels 177 formed into bottom wall 178 of bin 16' to receive slides 163, not shown, installed on bottom wall 118 of liner 116. Quick connect clips, not shown, can be provided in channels 177 to connect drawer 11' to slides 163, not shown, as described above in connection with FIG. 24. Following assembly of drawer 11', refrigerator or freezer drawer 11' can be assembled to cabinet 169 as described above for the two-temperature drawer 30. While the construction of refrigerator or freezer drawer appliance 10 is the same for a refrigerator drawer as for a freezer drawer, those skilled in the art will readily understand that the refrigeration system can be configured for operation at above freezing or below freezing temperatures. Those skilled in the art will understand that bins 16, 37, 46, 55, and 63 can have channels 177 in the bottom wall to facilitate connecting the respective drawers to slides 163 as in the case of bin 16' shown in FIG. 31. Likewise those skilled in the art will understand that all the embodiments of bins, 16, 16', 37, 46, 55 and 63 can have a flat bottom wall arranged to connect the bin to slides 163, or, if desired can have slides carried on side walls of the cabinet to engage side walls of the bins to slidably mount the drawers in the cabinets.

Figure 32:
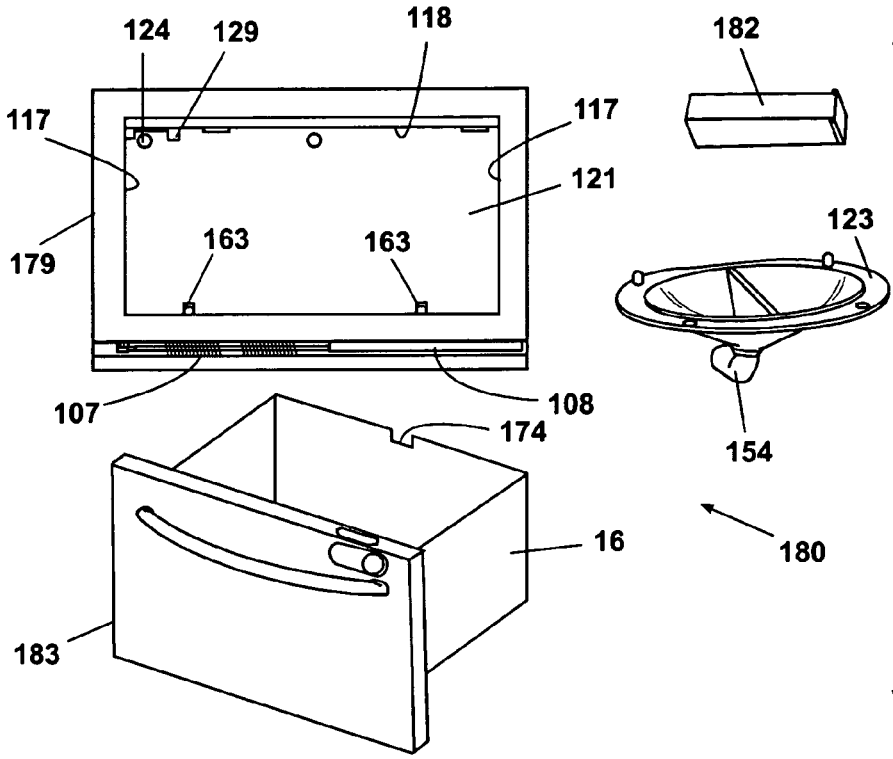
FIG. 32 is a partial exploded front view of another embodiment of the drawer appliance according to the invention with the drawer removed and with an ice maker removed from the cabinet.

Turning to FIG. 32 the construction of an ice drawer appliance 180 can be seen. Ice drawer appliance 180 can include a cabinet 179 that can include a base cabinet unit 99 as described above. An ice maker shown schematically at 182 removed from the ice drawer appliance can be mounted to the back wall 121. Ice maker 182 can include an evaporator for forming ice cubes and for cooling the interior of cabinet 179. Those skilled in the art will understand that ice maker 182 can be mounted to top wall 118 or side walls 117 instead of on back wall 121 if desired. Ice maker 182 can include a water line and electrical leads, not shown, that can pass through one of the openings 124 into machine compartment 130. Ice drawer 183 can be constructed in the same manner as refrigerator or freezer drawer 11' described above, and can be carried on slides 163, not shown, as the drawers for the other embodiments described herein.

Figure 33:
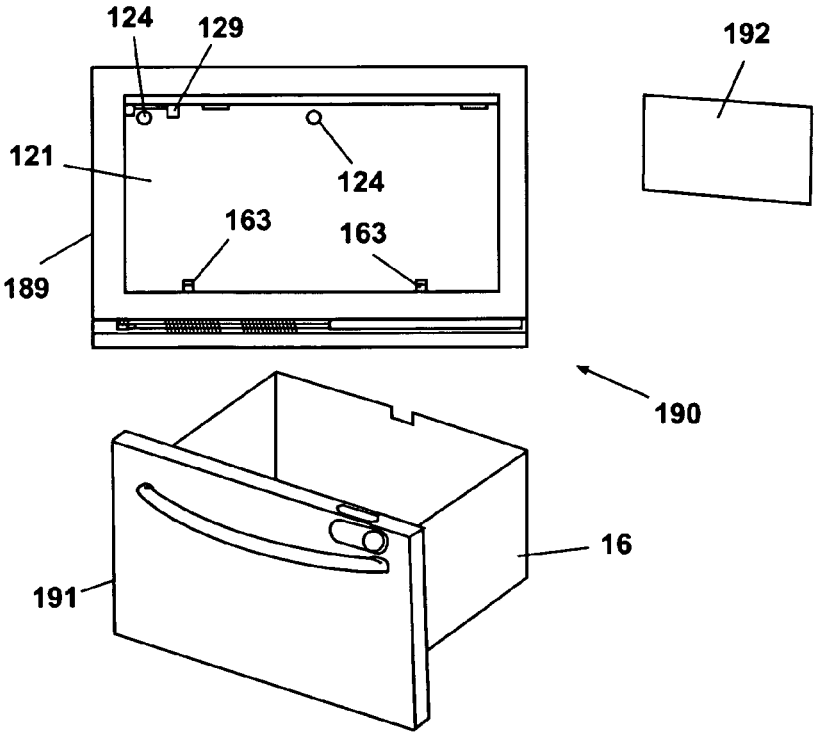
FIG. 33 is a partial exploded front view of another embodiment of the drawer appliance according to the invention with the drawer removed and a heater removed from the cabinet.

Turning to FIG. 33 the construction of a warming drawer appliance 190 can be seen. Warming drawer appliance 190 can include a cabinet 189 that can include a base cabinet unit 99 as described above. A heater element 192 can be mounted to rear wall 121. Heater element 192 can be mounted to rear wall 121 using suitable fasteners well known in the art. Those skilled in the art will understand that heater element 192 can be mounted directly to, or spaced from rear wall 121. Heater element 192 can be a metal plate have a serpentine heater wire attached to one surface of the plate, or can be another well known flat plate heater element. Heater element 192 can be sized to raise the temperature in warming drawer 191 to desired warming temperatures. Warming drawer 191 can be constructed in the same manner as the refrigerator and freezer drawer 11' and mounted to slides 163, not shown, using quick connect clips, not shown, all as described above.

Figure 34:
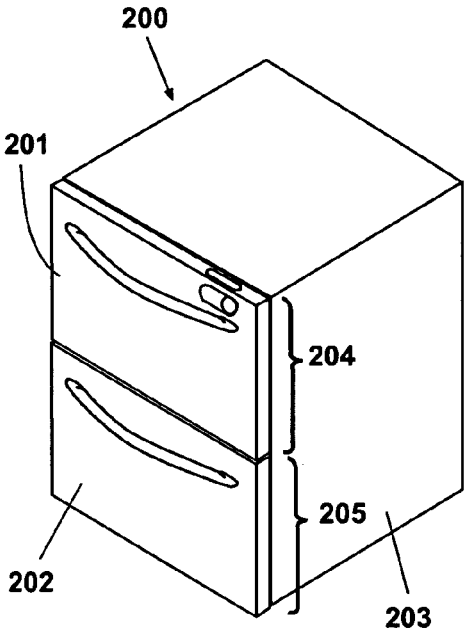
FIG. 34 is a front perspective view of another embodiment of the drawer appliance according to the invention.
Figure 34A:
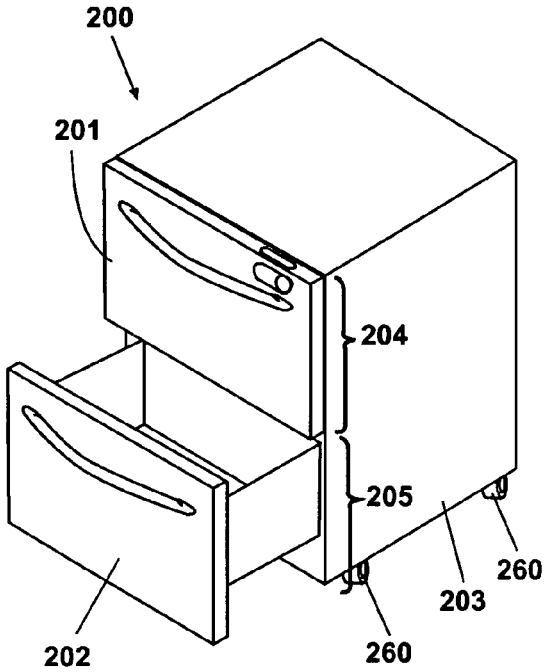
FIG. 34A is a front perspective view of the drawer appliance of FIG. 34 with the lower drawer open.

Turning to FIG. 34 and FIG. 34A another drawer appliance embodiment can be seen. Stacked drawer appliance 200 can include an upper drawer 201 that can be one of the drawer appliance units described above, namely a refrigerator, freezer, ice drawer, wine drawer or warming drawer. Lower drawer 202 can be an uninsulated storage drawer. Stacked drawer appliance cabinet 203 can include an insulated upper portion 204 surrounding upper drawer 201 that is constructed similar to base cabinet unit 99 but having a lower portion 205 that is uninsulated. For example, cabinet 203 can include a horizontal partition, not shown, separating the upper insulated portion 204 from lower uninsulated portion 205. The horizontal partition, not shown, can be similar to base 100. Cabinet 203 can be similar to wrapper 125 but having sidewalls that extend beyond the horizontal partition, not shown, and form lower portion 205. A lower base plate, not shown, can connect the opposite lower portions to form the two drawer cabinet 203. Likewise, a back wall, not shown can be provided to enclose the rear of cabinet 203. Cabinet 203 can be fabricated like base cabinet unit 99 described above except for the additional steps of installing and attaching a lower base plate, not shown. As mentioned above, lower portion 205 can be uninsulated to provide storage space. For instance, if upper drawer 201 is a refrigerator drawer, lower drawer could be used for bulk storage of cans or bottles of beverages, not shown, that can be added a few at a time to the refrigerated drawer 201. Those skilled in the art will readily understand that lower drawer 202 can be used for other storage purposes, and could if desired be replace by a side swing door providing access to the storage space. Further, those skilled in the art will understand that stacked drawer appliance 200 can be built into a counter unit, or can be freestanding, or mounted on wheels or casters 260 (see FIG. 34A) to provide a mobile drawer appliance for use in a recreation room or on a deck or patio.

Figure 35:
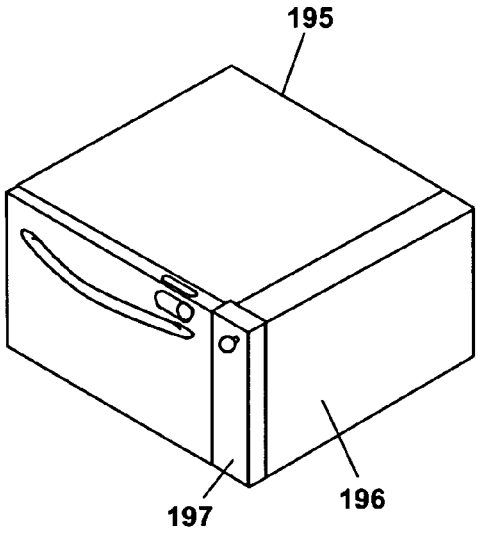
FIG. 35 is a front perspective view of another embodiment of the drawer appliance according to the invention having a side utility compartment.
Figure 36:
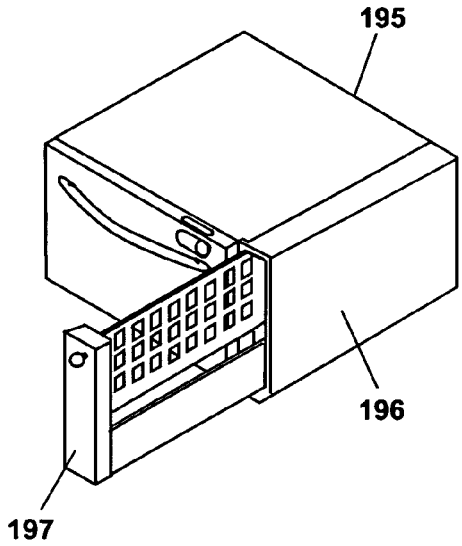
FIG. 36 is a front perspective view of the drawer appliance of FIG. 35 with the side utility compartment opened.
Figure 37:
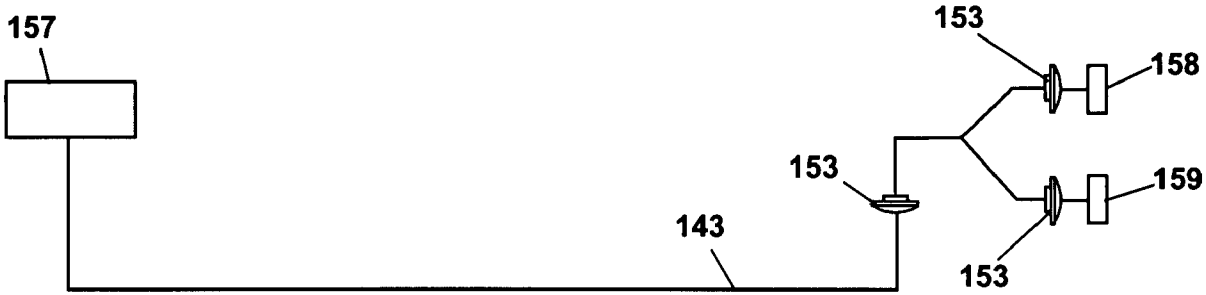
FIG. 37 is a diagram of a communication cable for connecting a drawer to a cabinet of a drawer appliance according to the invention.

Turning to FIG. 35 and FIG. 36 another drawer appliance embodiment can be seen. Drawer appliance 195 can include a base cabinet unit 99 as disclosed above configured for a refrigerator drawer, a freezer drawer, an ice drawer, a two temperature refrigerated drawer or a warming drawer. A sleeve 196 can be positioned adjacent one side of drawer appliance 195 to slidably hold a utility bin 197. Sleeve 196 can be dimensioned to allow drawer appliance 195 to fill a wider opening in a counter unit, not shown, that a base cabinet unit as described above. For example, sleeve 196 could be 3" wide to allow a 24" drawer appliance to fill a 27" opening in a counter unit. In this regard those skilled in the art will understand that a series of sleeves and utility bins of varying widths could be provided to allow drawer appliances to be conveniently used in a variety of counter opening sizes. Sleeve 196 can be fabricated of sheet material such as pre-painted aluminum or steel, or formed of plastic material. Likewise, utility bin 197 can be fabricated of sheet material or injection molded plastic. Those skilled in the art will understand that one or more suitable fasteners can be provided to attach sleeve 196 to drawer appliance 195.

Turning to FIGS. 37 through 41 a control and wiring arrangement that can be used to control operation of the drawer appliances disclosed in this application can be seen. The control and wiring harnesses will be described for use in conjunction with the two temperature refrigerated drawer appliance 20 however, the same control can be used for all drawer embodiments disclosed in this application. A diagram of communication cable 143 can be seen in FIG. 37. Communication cable 143 can include a connector 157 that can connect cable 143 to a mating connector 157' mounted in liner 116 to be accessible inside cabinet 31. The opposite end of cable 143 enters the back plate 140 of drawer 30 through a suitable grommet 153 to block insulating foam from leaking around the cable as is well known in the art. Connector 158 for LED lights 142 and connector 159 for display 34 and user interface 35 pass through grommets 153 into receptacles, not shown, in drawer front 32. Light fixtures 142, the display 34 and user interface 35 can be connected to the respective connectors 158 and 159 and the respective devices snapped, or otherwise mounted to the receptacles, not shown, positioned in the foam insulation.

Figure 38:
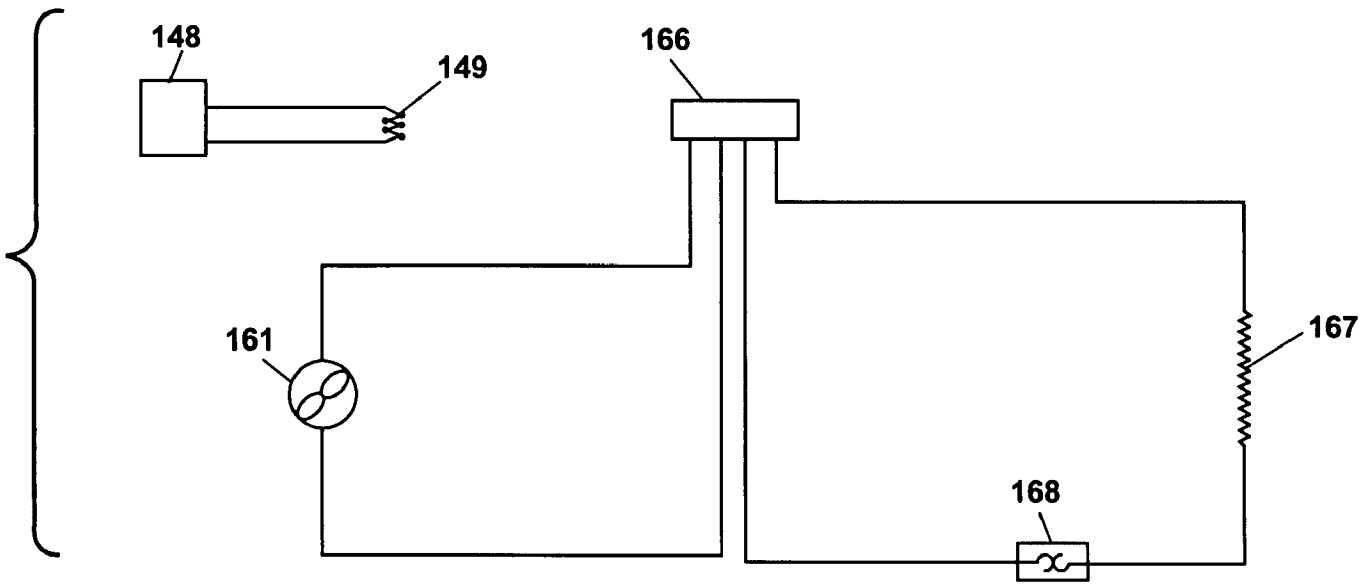
FIG. 38 is a schematic drawing showing connection of electrical components mounted in the cabinet of a drawer appliance according to the invention.

FIG. 38 is a schematic diagram showing the connection of electrical components in cabinet 31. Each evaporator fan 161 together with a defrost heater 167 and defrost bi-metal 168 can be connected via connector 166 to connector 166' mounted on back wall 121 or top wall 118. Defrost heater 167 can be a foil heater mounted on rollbond evaporator 160 as are well known in the art. Defrost bi-metal 168 can be positioned adjacent evaporator 160 and defrost heater 167 to open the circuit to defrost heater 167 when a predetermined temperature is achieved, again as is well known in the art. Those skilled in the art will understand that a suitable defrost heater can be provided below a tube and fin evaporator when a tube and fin evaporator is substituted for a rollbond evaporator. Those skilled in the art will also understand that in the case of the refrigerator drawer, freezer drawer and ice drawer embodiments there can be a single evaporator fan 161 and defrost heater 167 rather than two in the two temperature drawer embodiment. Similarly, in the warming drawer embodiment, heater 192 can replace the evaporator fan and defrost heater in FIG. 38 and can be connected via terminal 166. Thermistors 149 can be mounted as desired in the insulated space to sense the temperature in the respective compartments 38 and 39. Each thermistor 149 can be connected via connector 148 to a connector 148' that can be mounted on back wall 121 or top wall 118, or elsewhere in the insulated space. Those skilled in the art will understand that when the drawer appliance has one compartment instead of two as in the case of the two temperature drawer appliance only one evaporator fan, defrost heater, defrost bi-metal can be employed and the unused connectors 148' and 166' covered or plugged as is well known in the art.

Figure 39:
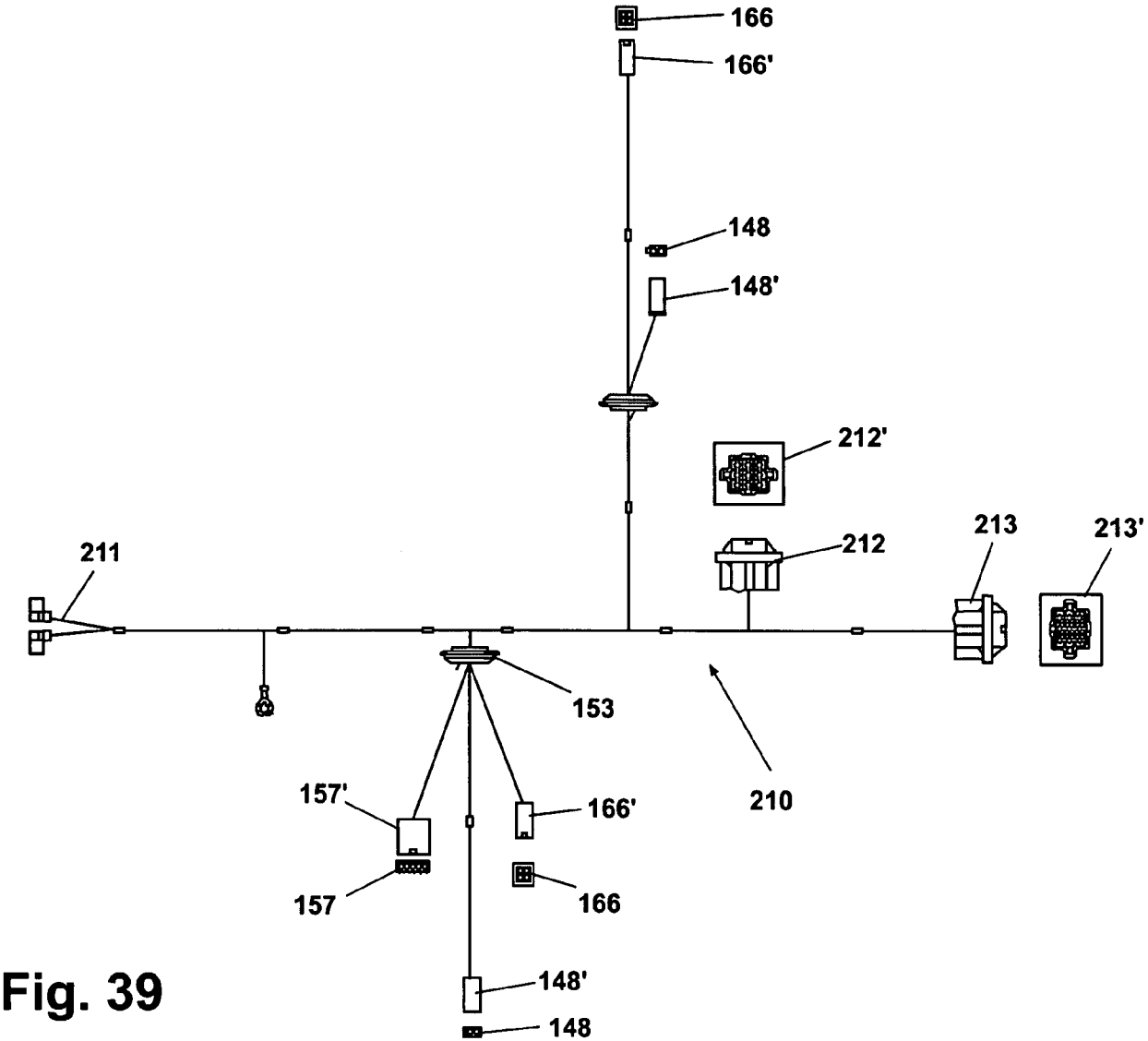
FIG. 39 is a diagram of a wiring harness installed between the liner and the Z bracket during assembly of a drawer appliance according to the invention.

Turning to FIG. 39 a diagram of a wiring harness 210 that can be foamed in place between liner 116 and Z bracket 105 can be seen. Wiring harness 210 can include connectors 157', 148' and 166' that connect with corresponding connectors 157, 148 and 166 as described in conjunction with FIGS. 37 and 38. Wiring harness 210 also can include terminals 211 that can connect to light switch 129 mounted to top wall 118. As will be understood by those skilled in the art light switch 129 can be provided with a cup hood to prevent foam from contacting terminals 211, or other suitable means such as a grommet 153 can be provided on wiring harness 210 to protect terminals 211. Wiring harness 210 can also include connectors 212 and 213 that mount in vertical wall 109 to open into machine compartment 130 to allow connection of machine compartment wiring harness 215 to foamed in place wiring harness 210.

Figure 40:
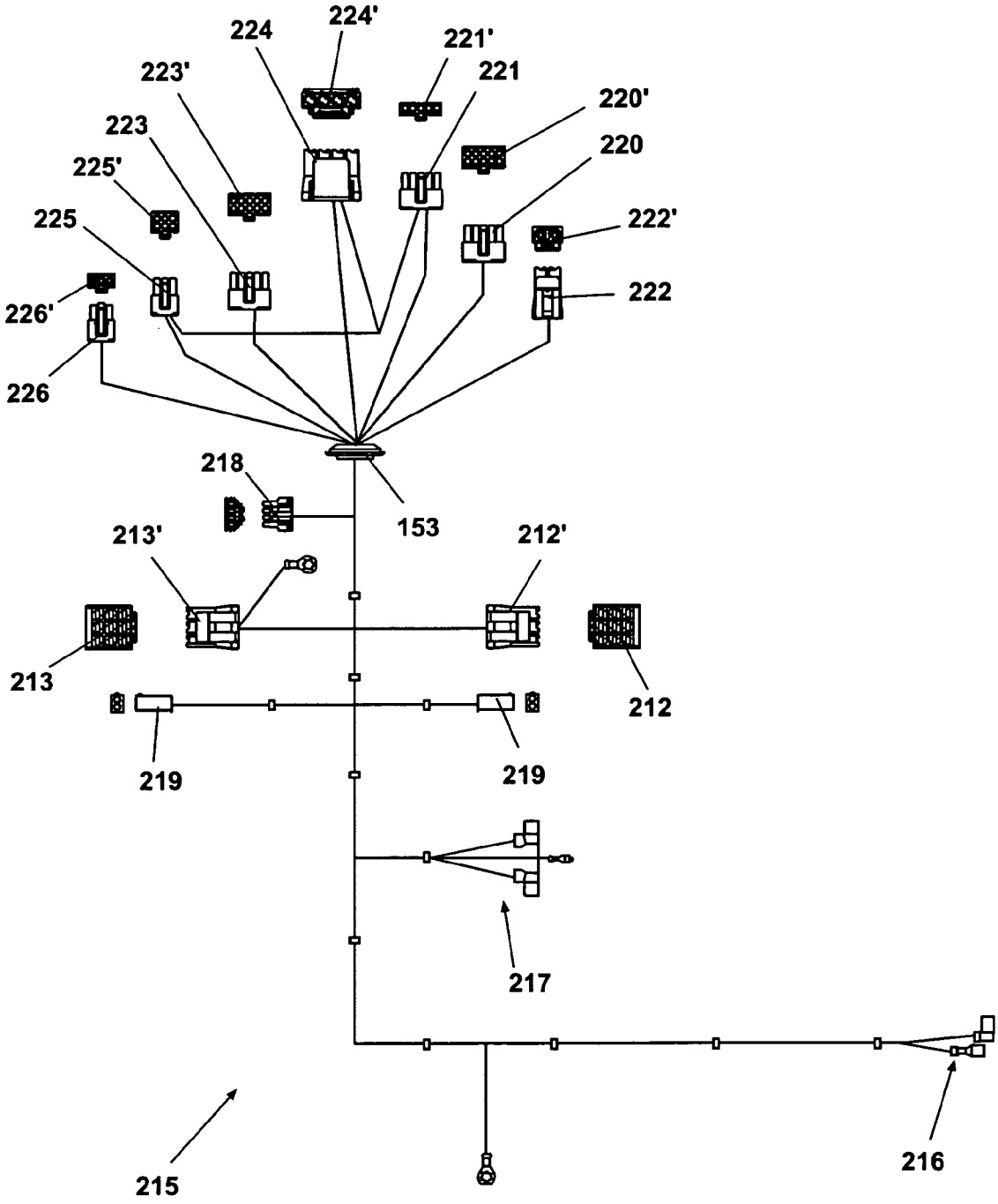
FIG. 40 is a schematic drawing of a wiring harness for use in the machine compartment of a drawer appliance according to the invention.
Figure 41A:
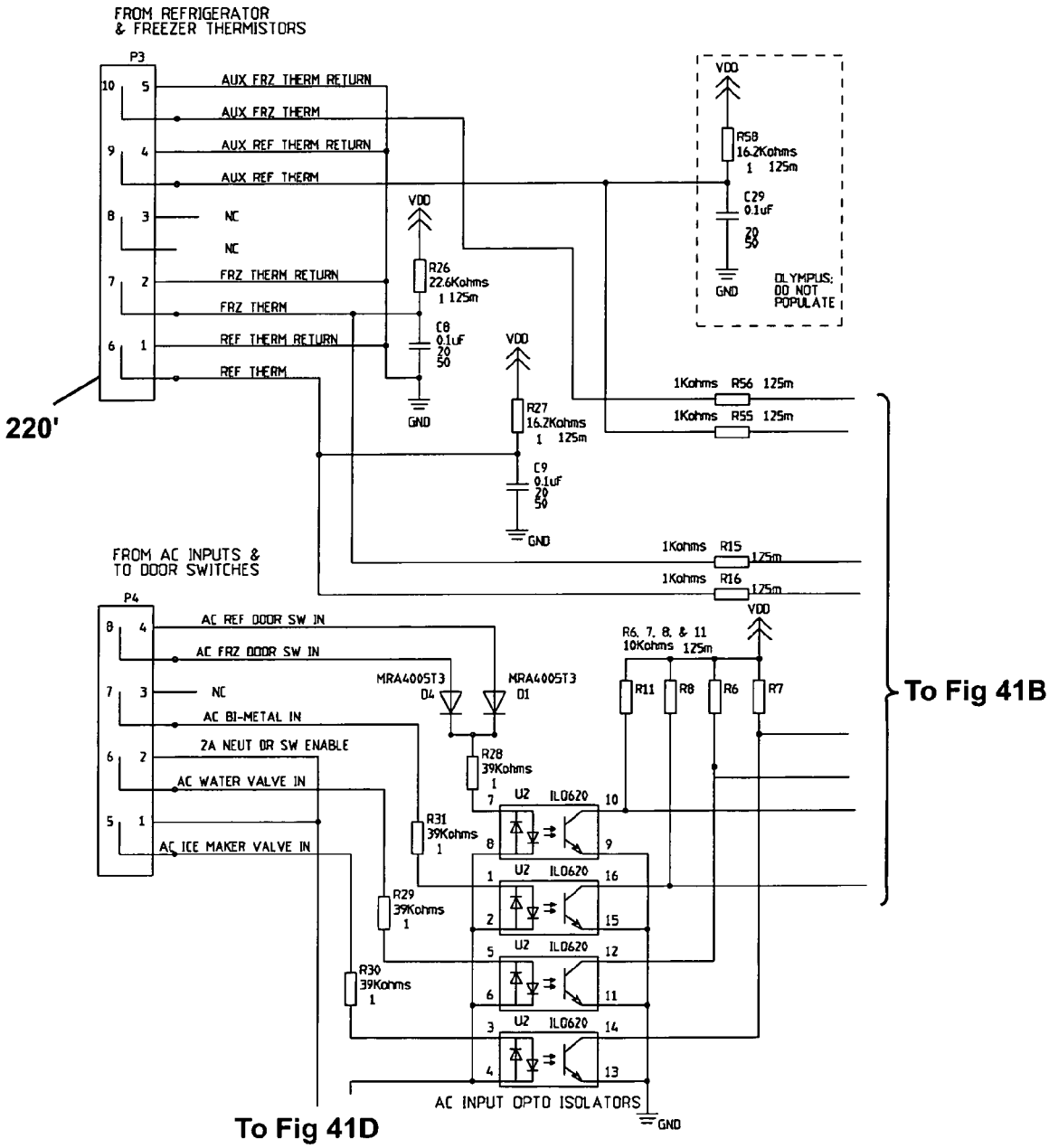
FIG. 41A is a portion of a schematic drawing of a control for the drawer appliance according to the invention.
Figure 41B:
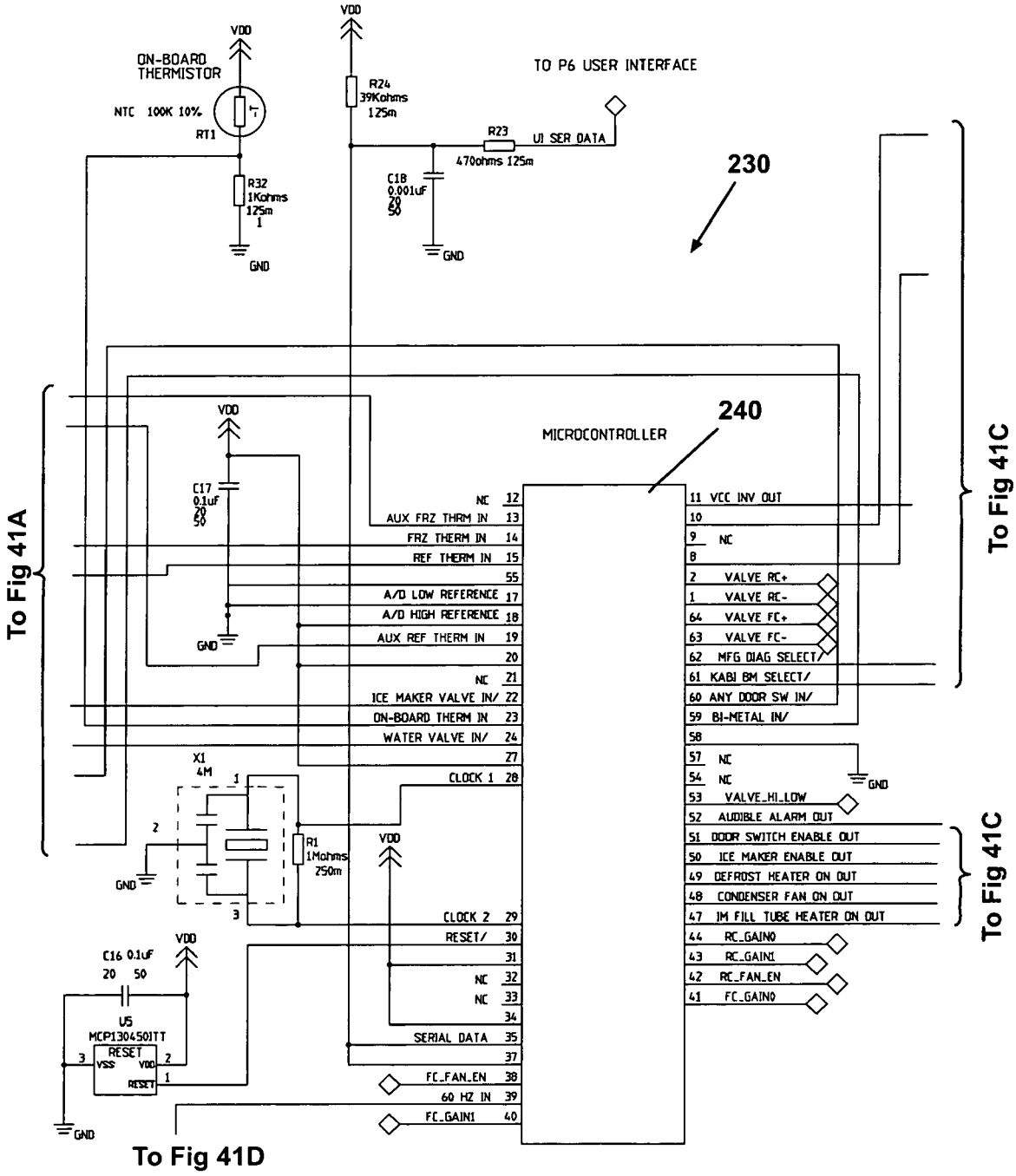
FIG. 41B is another portion of a schematic drawing of a control for the drawer appliance according to the invention.
Figure 41C:
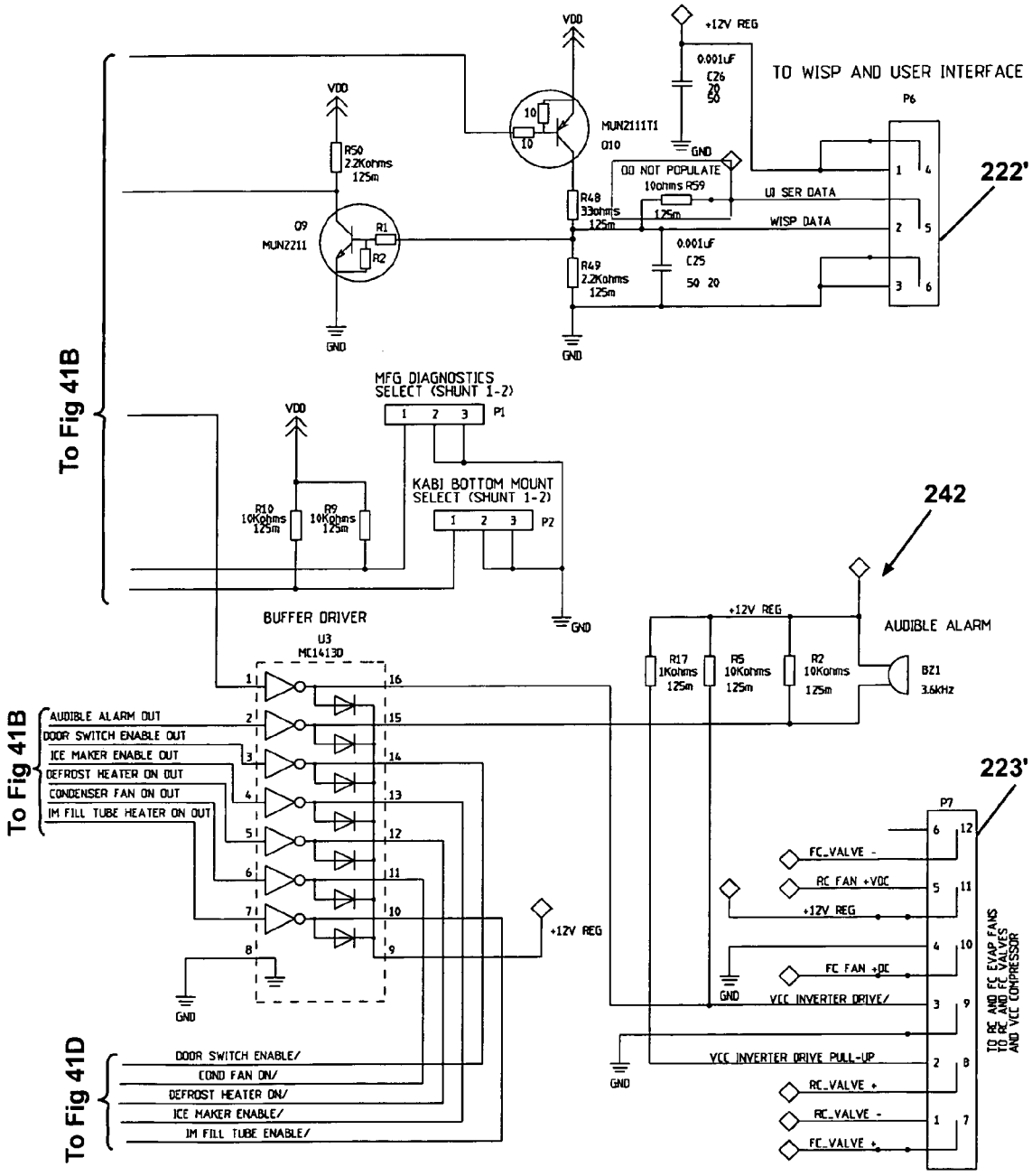
FIG. 41C is another portion of a schematic drawing of a control for the drawer appliance according to the invention.
Figure 41D:
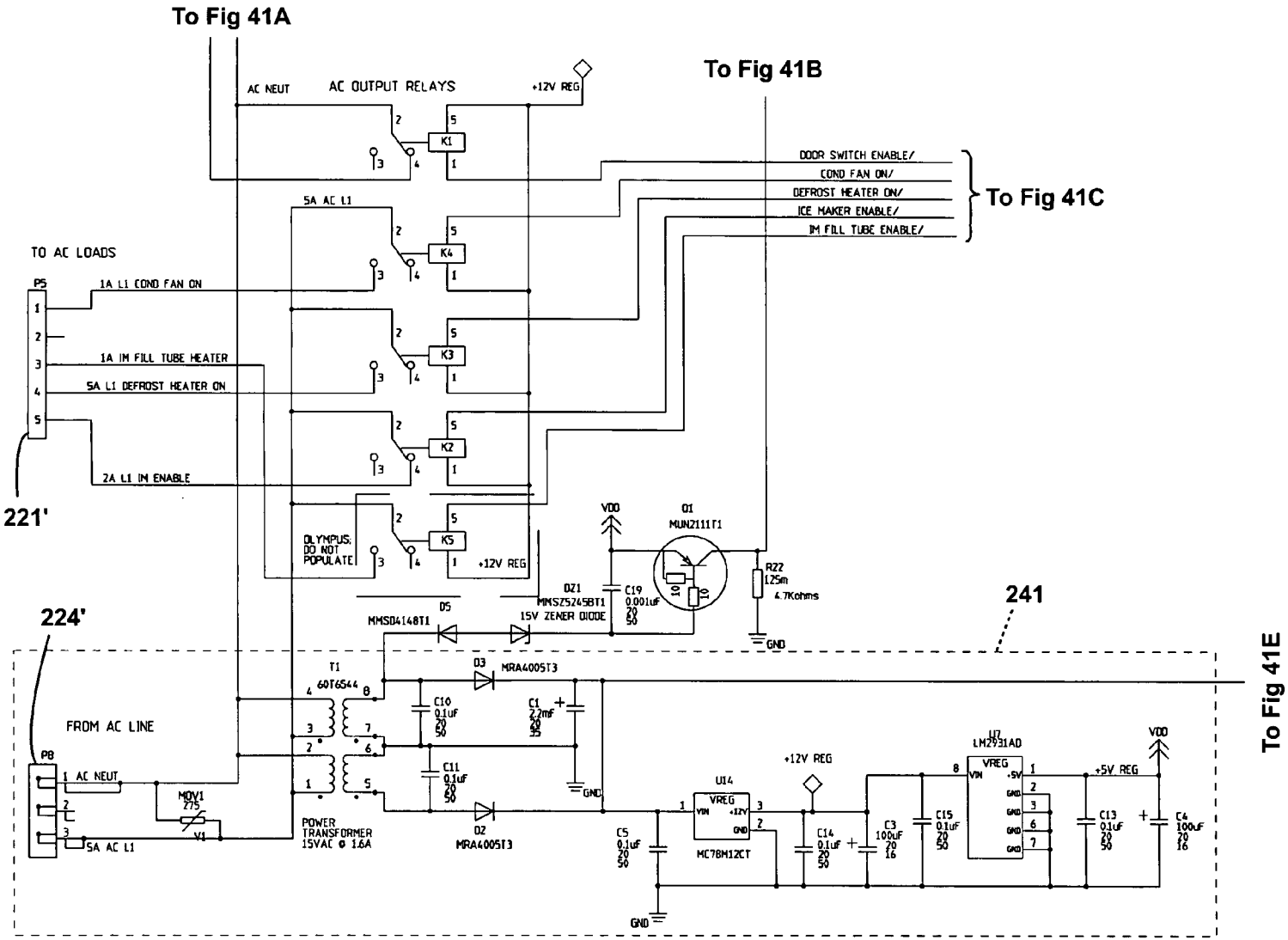
FIG. 41D is another portion of a schematic drawing of a control for the drawer appliance according to the invention.
Figure 41E:
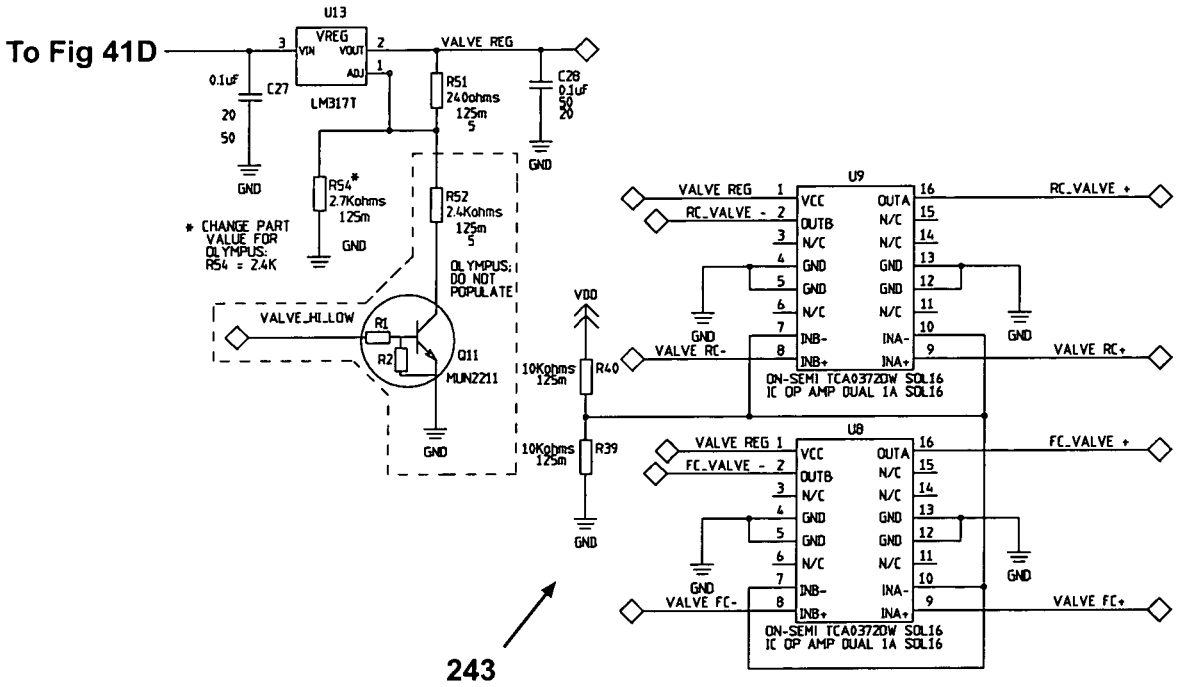
FIG. 41E is another portion of a schematic drawing of a control for the drawer appliance according to the invention.

Turning to FIG. 40 a diagram of a wiring harness 215 that can be used in machine compartment 130 to connect components and controls located in the machine compartment together and to the foamed in place wiring harness 210 can be seen. Terminals 216 can connect to an on/off switch, not shown, that can be positioned on the front of wine drawer appliance 20. As mentioned above, channel 111 can provide a conduit for the wiring harness leads from terminals 216 for an on/off switch to the control board. Terminals 217 can connect to terminals, not shown, on compressor 150 to allow the control described below to operate compressor 150 when desired to provide cooling in one of the compartments 38 or 39. Wiring harness 215 can include connectors 212' and 213' to connect wiring harness 215 to wiring harness 210. Wiring harness 215 can also include terminals 218 to connect to terminals, not shown, on condenser fan 151 to allow the control described below to operate condenser fan 151. As mentioned above, when refrigerated drawer appliance 20 is provided with two compartments 38 and 39 that can operate at different temperatures the refrigeration system can include a refrigerant valve, not shown, in the refrigerant circuit to each evaporator 160 to control flow of refrigerant to the respective evaporators as is well known in the art. The refrigerant valves, not shown, can be mounted on vertical wall 109 adjacent compressor 150 to facilitate connection in the refrigerant circuits for the evaporators 160. A pair of terminals 219 can be included in wiring harness 215 that can be connected to terminals, not shown, on the respective refrigerant valves, not shown. Connectors 220, 221, 222, 223 and 224 can connect to corresponding connectors 220', 221', 222', 223' and 224' on control 230 mounted in control box 155. Connectors 225 and 226 can connect to corresponding connectors 225' and 226' for LED power supply 231 mounted on the circuit board for control 230. Those skilled in the art will understand that wiring harnesses 210 and/or 215 can be provided with additional leads and connectors when the drawer appliance is arranged to provide additional functions such as in the case of an ice drawer requiring electrical leads for the ice maker in the refrigerated compartment and a water valve, not shown, that can be mounted on vertical wall 109 in machine compartment 130.

Turning to FIGS. 41A–41E a schematic diagram of a control 230 that can be used to operate the drawer appliance embodiments described in this application can be seen. Control 230 can be a conventional electronic refrigerator control that can be easily adapted for use with all of the drawer appliances according to the invention. Those skilled in the art will recognize and understand that the entire control 230 may not be used for certain configuration drawer appliances, and certain unused portions of control 230 that are not used in conjunction with drawer appliances have been omitted in FIGS. 41A–41E to facilitate understanding of the control 230. Control 230 can include a microprocessor 240 and a power supply 241 for the control 230. Control 230 can include an audible alarm 242 that can be used to warn a user that a drawer has been left open, or other condition as desired. Circuit portion 243 can be arranged to operate refrigerant valves when used to provide two-temperature operation as is the case with the refrigerated drawer 20 having two compartments. Connector 221' can provide control and power to an ice maker for use in the ice drawer embodiment. Connector 220' can connect a thermistor or thermistors 149 to control 230 to allow control 230 to operate compressor 150 to cool the drawer (refrigerator, freezer, ice drawer and two temperature drawer embodiments), or heater 192 to heat warming drawer 191 in the warming drawer embodiment. Those skilled in the art will understand that the same control 230 can be used for the embodiments of the drawer appliance described in this application if desired. Those skilled in the art will also understand that the microprocessor 240 can be provided with a distinct control algorithm for each embodiment of the drawer appliance. Microprocessor 240 can also be arranged to be flash programmed to set the control algorithm for each embodiment of the drawer appliance. The operation of electronic refrigerator controls is well known in the art and will not be described in further detail.

Figure 6A:
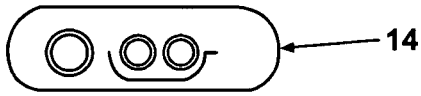
FIG. 6A is a view showing the layout of a user interface for the drawer of FIG. 6.

In operation, a drawer appliance can be operated by switching the main power switch, not shown, at the bottom edge of the cabinet to the on position. Next, the user can turn the drawer appliance on and select the desired temperature by accessing the user interface 14 or 35 (see FIG. 6A and FIG. 7A). For refrigerator, freezer, ice drawer and warming drawer embodiments a user interface as shown in FIG. 6A can be used since a single cooling or heating element is controlled. For the two-temperature refrigerated drawer embodiment having two compartments a user interface as shown in FIG. 7A can be used to allow separate control of the temperatures in the compartments 38 and 39. The user can also activate light fixtures 142 by pressing the LIGHT pad on user interface 35. User interfaces 14 and 35 can be conventional touch pad user interface panels well known in the art. Those skilled in the art will understand that other well known user interface devices such as push buttons and the like can be used in place of the touch pad user interfaces 14 or 35.

A completed drawer appliance can be mounted in a counter unit 5 on a frame work integral with the counter unit. Alternately, channel or "L" brackets can be installed and attached to a counter unit to support a drawer appliance in a desired location. Suitable fasteners can be provided to secure the drawer appliance cabinet to the counter unit or to the "L" brackets as desired to prevent the drawer appliance from tipping or inadvertently pulled out of the counter unit. Similarly, freestanding units as shown in FIG. 34 and 35 can be provided with appropriate anti-tip brackets or clips to prevent the stacked drawer appliance from tipping when drawers 201 or 202 are opened.

Figure 42:
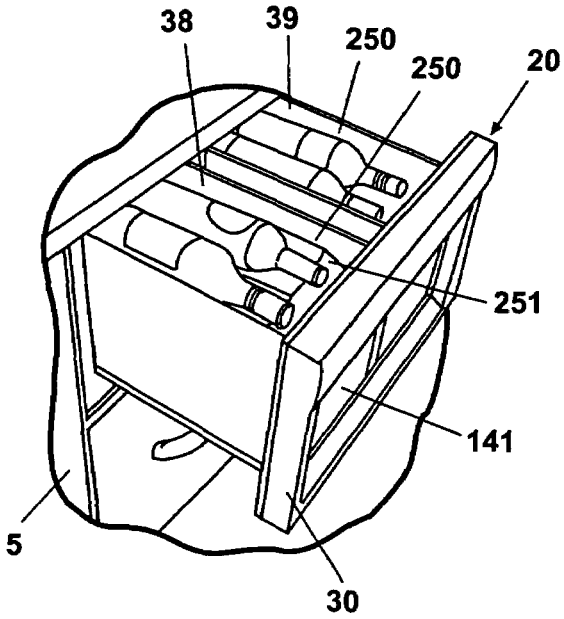
FIG. 42 is a partial perspective view of a wine drawer appliance according to the invention showing one wine bottle rack embodiment.
Figure 43:
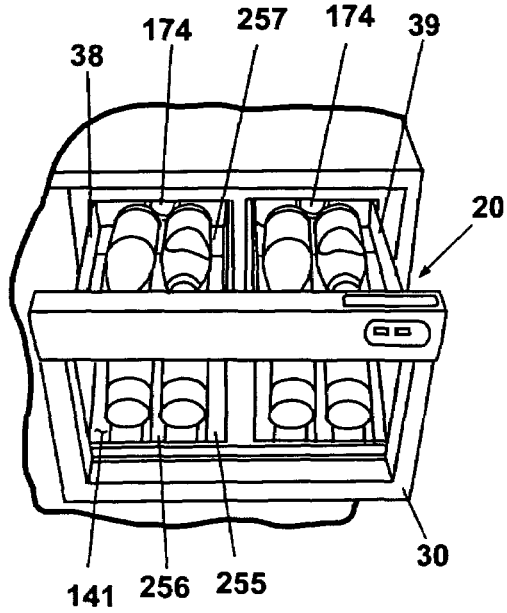
FIG. 43 is a partial perspective view of a wine drawer appliance according to the invention showing another wine bottle rack embodiment.

Turning to FIG. 42 and 43 two embodiments of wine racks for use in a two temperature drawer 30 illustrated above as a wine drawer can be seen. In the embodiment of FIG. 42 each compartment 38 and 39 can include a molded plastic drawer insert 250. Each drawer insert 250 can include two support areas, not shown, for supporting the base of two wine bottles. At the opposite side of each compartment a bottle support rod 251 can be held in a position to support the neck to two wine bottles. In the embodiment of FIG. 42 bottle support rods 251 can be held in position by recesses formed in drawer inserts 250. As can be seen by referring to FIG. 42 the wine rack of this embodiment can hold four wine bottles in each compartment space apart so that the user can readily see the wine bottles through insulated window 141. Referring to FIG. 43 another wine rack embodiment can be seen. In the embodiment of FIG. 43, wine rack 255 can include an angled wood support 256 arranged to support two wine bottles lying their sides. At the back edge of support 256 a vertical support 257 can be provided to support two additional wine bottles above the lower bottles lying on support 256. The neck of the two upper bottles can be supported by a wire mounted to the side of the drawer or to the wine rack as desired. Those skilled in the art will understand that the lower drawer appliance in FIGS. 42 and 43 can be any of the drawer appliance embodiments disclosed in this application.

Figure 44:
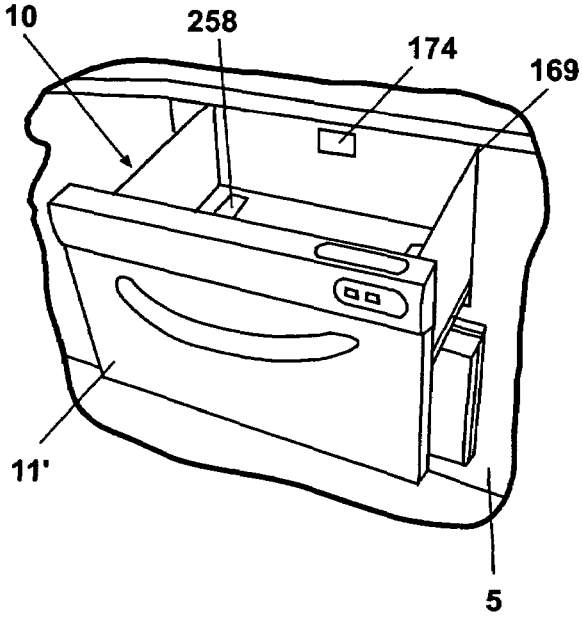
FIG. 44 is a partial perspective view of a refrigerator drawer appliance.
Figure 45:
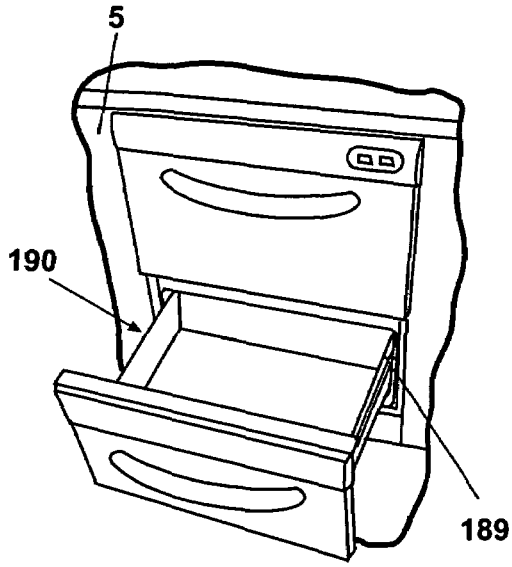
FIG. 45 is a partial perspective view of a warming drawer appliance.

Turning to FIGS. 44 and 45 a refrigerator drawer cabinet 169 can be seen mounted above a warming drawer cabinet 189. Food items 258 can be seen in the refrigerator drawer. In the embodiment shown in FIG. 45, warming drawer 191 can have a bin fabricated of stainless steel.

Referring again to FIGS. 42 to 45 it can be seen two separate drawer appliances are mounted in a counter unit 5 one above the other under a counter top. Those skilled in the art will also understand that three or more drawer appliances can be similarly stacked in a cabinet extending higher than normal countertop height, or drawer appliances having a smaller vertical dimension can be provided to allow stacking of three or more units under a conventional counter unit.

While the invention has been specifically described in connection with certain specific embodiments thereof, it is to be understood that this is by way of illustration and not of limitation, and the scope of the appended claims should be construed as broadly as the prior art will permit.

We claim:

1. A refrigerated drawer appliance comprising:

a cabinet having an insulated drawer space and a machine compartment;

an insulated mullion dividing the drawer space into two compartments;

a refrigeration system including an evaporator in the drawer space and a compressor in the machine compartment arranged for cooling each of the compartments to an independently selected temperature; and a drawer comprising two bins arranged to be positioned in the two compartments when the drawer is in the closed position.

2. The refrigerated drawer appliance according to claim 1, wherein the bins are arranged to enter the drawer space on opposite sides of the mullion.

3. The refrigerated drawer appliance according to claim 1, wherein the drawer comprises an insulated front and the bins are attached to the inside of the front.

4. The refrigerated drawer appliance according to claim 1, wherein the refrigeration system includes at least one evaporator in one of the compartments.

5. The refrigerated drawer appliance according to claim 1, wherein the refrigeration system includes an evaporator in each of the compartments.

6. The refrigerated drawer appliance according to claim 1, further including a control for independently controlling the temperature in the two compartments and a user interface on the drawer for selecting the temperatures for the two compartments.

7. The refrigerated drawer appliance according to claim 6, further including a display on the drawer for displaying the temperatures in the compartments.

8. The refrigerated drawer appliance according to claim 1, further including a hinged lid for at least one of the bins.

9. The refrigerated drawer appliance according to claim 1, wherein the drawer includes a front wall and further including at least one window in the drawer front wall for viewing the contents of at least one of the bins when the drawer in positioned in the drawer space.

10. The refrigerated drawer appliance according to claim 9, wherein the drawer further includes a light to illuminate the interior of at least one of the bins when the drawer is positioned in the drawer space.

11. The refrigerated drawer appliance according to claim 9, further including a wine rack in at least one of the bins for holding a plurality of wine bottles.

12. The refrigerated drawer appliance according to claim 11, wherein the wine rack holds a plurality of bottles spaced apart for viewing when the drawer is positioned in the drawer space.

13. The refrigerated drawer appliance according to claim 12, where a wine rack is positioned in each bin.

14. The refrigerated drawer appliance according to claim 1, further including a slidable tray covering the open top of the drawer in a closed position and exposing the open top of the drawer in an open position.

15. The refrigerated drawer appliance according to claim 14, wherein the slidable tray includes a plurality of recesses arranged for holding utensils and serving accessories.

16. A refrigerated drawer appliance comprising:

an insulated cabinet having a drawer space and a machine compartment;

an insulated mullion in the liner dividing the drawer space into two compartments;

at least one evaporator positioned in one of the compartments connected to a compressor and a condenser in a refrigeration circuit;

a first fan positioned adjacent the evaporator in the one of the compartments;

a second fan positioned in the liner arranged to circulate refrigerated air into the other of the two compartments;

a temperature sensor for each of the two compartments connected to a control arranged to control operation of the compressor and the first and second fans; and a drawer including an insulated front wall and two bins arranged to be positioned in the two compartments when the drawer is in the closed position.

17. The refrigerated drawer appliance according to claim 16, wherein the second fan is positioned in the mullion to circulate refrigerated air into the other of the two compartments.

18. The refrigerated drawer appliance according to claim 16, wherein the drawer includes a front wall including windows for viewing the contents of the bins when the drawer in positioned in the drawer space.

19. The refrigerated drawer appliance according to claim 18, wherein the drawer further includes a light to illuminate the interiors of each of the bins when the drawer is positioned in the drawer space.

20. The refrigerated drawer appliance according to claim 19, further including a wine rack in at least one of the bins for holding a plurality of wine bottles spaced apart for viewing when the drawer is positioned in the drawer space.

* * * * *